US006257945B1

(12) United States Patent
Nakayama

(10) Patent No.: US 6,257,945 B1
(45) Date of Patent: Jul. 10, 2001

(54) METHOD FOR SEALING A GAS WITHIN A PICTURE DISPLAY DEVICE

(75) Inventor: Akira Nakayama, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/142,389

(22) PCT Filed: Jan. 14, 1998

(86) PCT No.: PCT/JP98/00118

§ 371 Date: Mar. 23, 1999

§ 102(e) Date: Mar. 23, 1999

(87) PCT Pub. No.: WO98/32148

PCT Pub. Date: Jul. 23, 1998

(30) Foreign Application Priority Data

Jan. 16, 1997 (JP) ..... 9-005807

(51) Int. Cl.[7] ..... H01J 9/26
(52) U.S. Cl. ..... 445/25; 445/24; 445/43
(58) Field of Search ..... 445/24, 25, 42, 445/43

(56) References Cited

U.S. PATENT DOCUMENTS 5,797,780 * 8/1998 Peng ..... 445/25

FOREIGN PATENT DOCUMENTS 2210012 5/1974 (FR) .
2225833 8/1974 (FR) .
41-20752 10/1966 (JP) .
48-12980 2/1973 (JP) .
57-24620 * 5/1982 (JP) ..... 445/25

* cited by examiner

*Primary Examiner*—Nimeshkumar D. Patel
*Assistant Examiner*—Joseph Williams
(74) *Attorney, Agent, or Firm*—Sonnenschein, Nath & Rosenthal

(57) ABSTRACT

A method for producing a picture display device is disclosed. A glass tube is placed in an opening area of the through-hole formed at a pre-set position of a first substrate of a hermetically sealed assembly comprised of the first substrate and a plate element spaced apart from the first substrate a pre-set distance, with the perimetral area of the resulting assembly being sealed with a sealant to provide a hermetically sealed assembly. A calcined solid frit held by a holding member is placed in the vicinity of a bond of the glass tube to the through-hole in the glass tube, and the inside of the hermetically sealed assembly is evacuated via the glass tube. A pre-set portion of the glass tube is radially compressed to form a constricted portion, with the calcined solid frit being left between the constricted portion and the opening area of the through-hole. The calcined solid frit is moved to the constricted portion of the glass tube. A gas is then charged into the gap between the first substrate and the plate member via the glass tube and the calcined solid frit in the constricted portion in the glass tube is melted and solidified for hermetically sealing the constricted portion. This effectively seals the glass tube by stopping with the frit material.

10 Claims, 21 Drawing Sheets

METHOD FOR SEALING A GAS WITHIN A PICTURE DISPLAY DEVICE

TECHNICAL FIELD

This invention relates to a method for producing a picture display device having a pair of substrates spaced apart a pre-set distance to define a gap in which a gas is enclosed. More particularly, it relates to a method for producing a highly reliable picture display device to high productivity even if the gas is enclosed under a pressure of the order of atmospheric pressure.

BACKGROUND ART

Recently, development of a picture display device, termed a flat display device having a flat shape in distinction from a CRT display device, is briskly underway. This picture display device may be enumerated by a plasma display exploiting light emission from a phosphor element due to emission of ultraviolet rays by electrical discharge (referred to herein as PDP).

This PDP includes a pair of substrates arranged facing each other to define a gap in which an ionizable gas is enclosed. On the inner surface of one of the substrates is arranged the phosphor element. Electrical discharge is produced in the ionizable gas and a picture is displayed by light emission from the phosphor element by radiation of the ultraviolet rays produced by discharge.

This PDP is roughly classified into a so-called DC type PDP in which discharge electrodes are arranged on both the substrate provided with the phosphor element and the substrate not provided with the phosphor element for facing each other in order for the electrical discharge to take place along the thickness, and a so-called AC type PDP in which the discharge electrode is provided only on the substrate not carrying the phosphor element and the discharge electrode is covered by a dielectric layer in order for the electrical discharge to take place in the in-plane direction.

As a flat type display, other than the PDP, a picture display device of the type in which a liquid crystal layer having an enclosed liquid crystal is driven in accordance with a so-called active matrix system of driving an active element, such as a transistor, provided from pixel to pixel (referred to hereinafter as a TFT liquid crystal display) is stirring up notice.

However, with the TFT liquid crystal display, since it is necessary to provide a large number of semiconductor devices, such as transistors, there is raised a problem of production yield in case a display of a large area is used for forming a large-sized screen, thus raising production cost.

For solving these problems, there has also been proposed a picture forming device operating under a system in which discharge plasma is used in place of MOS transistors or thin-film transistors as active elements.

This type of the picture display device may be such a device having a display panel which is obtained on superposing a plasma cell having plural discharge electrodes for plasma discharge with a second substrate having electrodes substantially at right angles to the discharge electrodes via a liquid crystal layer of a liquid crystal as an electro-optical material.

The plasma cell includes a first substrate, having plural substantially parallel discharge electrodes on its major surface and a thin sheet of a dielectric material at a pre-set separation from the first substrate. An ionizable gas is sealed in the space between the first substrate and the thin dielectric sheet and the peripheral portion of the resulting assembly is sealed with a sealant. This plasma cell is divided by partitioning wall sections into plural line-shaped plasma chambers in which plasma discharge can be produced.

The second substrate has plural electrodes extending substantially at right angles to the discharge electrodes of the plasma cell on its major surface. This second substrate is superimposed via liquid crystal layer on the dielectric plasma sheet of the plasma cell with the electrode carrying surface as the facing side.

In this display panel, the liquid crystal is driven by sequentially switching scanning the plasma chambers of the plasma cell and by applying a signal voltage across the electrodes of the second substrate facing the plasma cell with the interposition of the liquid crystal layer in synchronism with the switching scanning, with the portions of the plasma chambers intersecting with the electrodes of the second substrate delimiting pixels.

In both the PDP and the picture display device in which the liquid crystal layer is driven by discharge plasma, it is necessary for an ionizable gas to be enclosed between the facing substrate pairs or between the first substrate and the thin dielectric sheet, as described above. This ionizable gas is sealed by boring a through-hole in the substrate, inserting a glass tube therein, evacuating the space via this glass tube, charging the gas into the space and sealing the glass tube. This sealing of the glass tube is by heating the glass tube, radially compressing the glass tube by external pressure under heating and burning off the outer portion for allowing the end to be sealed spontaneously, or by compressing the tube to a bar and cutting off its distal end.

Recently, the sealed gas tends to be compressed to a higher pressure. Specifically, while the gas was sealed hitherto under vacuum or under a low vacuum less than one atmosphere, the pressure in the vicinity of one atmosphere or a higher pressure is used in sealing the gas.

If such higher pressure is used, the pressure in the tube is higher than the external pressure, that is atmospheric pressure, the glass tube becomes difficult to seal with the conventional method. That is, if the glass tube is heated for sealing, the glass becomes softened or melted to raise the internal pressure to a value higher than the external pressure. Thus, the heated portion is expanded like a balloon and explodes to render sealing impossible.

In the manufacture of a tube bulb, a tube of oxygen-free copper is evacuated and charged with a gas until the gas pressure is equal to or higher than the external pressure. After charging the gas, the end of the tube bulb is pinched off for sealing. This method is not desirable in view of increased production cost and lowered productivity brought about by the difficulty in mounting the tube of oxygen-free tube in position.

Thus, for sealing a glass tube of a picture display device in which the gas is sealed under a higher sealing pressure, it may be envisaged to raise the external pressure to higher than one atmosphere for apparently lowering the pressure in the glass tube for sealing the glass tube, or to raise the temperature of the glass tube to close to the glass softening temperature for pinching off the distal end of the tube.

However, with the former method, the method of sealing the glass tube is limited to heat-sealing by a heater wire or high frequency heating sealing. Since it is necessary in this case to seal the portion around the sealing point hermetically, thus increasing the size of the sealing device. In addition, the sealing needs to be performed individually from one glass tube to another, thus affecting mass producibility or productivity.

With the latter method, the glass tube needs to be increased in tube thickness because the tube tends to be expanded if it is reduced in wall thickness. In this case, the glass tube is heated and compressed gradually and pinched off ultimately. This pinch-off process affects the reliability of the picture display device such that operational reliability of the resulting product cannot be assured. In addition, the pinch-off process frequently leads to impact applied to the paired substrates or to the first substrate and the thin dielectric sheet, such that the connecting portion between the glass tube and the substrate formed of a sealant material is subjected to peeling to affect the reliability.

Thus, in the manufacturing method for the picture display device, it is incumbent to render it possible to provide a picture display device capable of coping with the increased sealant gas pressure in order to improve mass-producibility and operational reliability of the picture display device.

DISCLOSURE OF THE INVENTION

It is therefore an object of the present invention to provide a manufacturing method for a picture display device capable of coping with increased pressure of the sealed gas and having optimum mass-producibility and high productivity and reliability.

For accomplishing the above object, the present invention provides a method for producing a picture display device including a first step of connecting a glass tube in an opening area of a through-hole formed at a pre-set position of a major surface of a first substrate opposite to its other major surface facing a plate member placed at a pre-set separation from the first substrate, the first substrate and the plate member placed thereon constituting an assembly the peripheral portions of which are hermetically sealed to form a hermetically sealed assembly, a second step of arraying a calcined solid frit held by a holding member in the vicinity of a bond of the glass tube to the through-hole in the glass tube, a third step of evacuating the gap between the first substrate and the plate member via the glass tube, a third step of radially compressing a pre-set portion of the glass tube to from a constricted portion, with the calcined solid frit being left between the constricted portion and the opening area of the through-hole, a fourth step of moving the calcined solid frit to the constricted portion of the glass tube, a fifth step of charging the gas into the gap between the first substrate and the plate member via the glass tube and a sixth step of melting and solidifying the calcined solid frit in the constricted portion in the glass tube for hermetically sealing the constricted portion.

In the method for producing the picture display device of the present invention, the holding member for the calcined solid frit may be made up of a metal plate inserted into the calcined solid frit and a spring member for holding the metal plate in the glass tube, with the metal plate being heated by high frequency heating for dismounting the calcined solid frit from the holding member for moving the calcined solid frit to the constricted portion.

In the method for producing the picture display device of the present invention, the holding member for the calcined solid frit may be made up of a ferromagnetic plate inserted into the calcined solid frit and a spring member for holding the metal plate in the glass tube, with the ferromagnetic plate being excited into vibrations by an electromagnet for moving the calcined solid frit along with the holding member to the constricted portion.

In the method for producing the picture display device of the present invention, a plurality of discharge electrodes may be formed substantially parallel to one another while a thin dielectric sheet is arranged as the plate member and a plasma cell is formed as the hermetically sealed assembly. In this case, the method further includes a step performed subsequently to the sixth step, the step being a step of layering a second substrate on the thin dielectric sheet of the plasma cell via an electro-optical layer. The second substrate has electrodes formed on its facing surface for extending substantially at right angles to the discharge electrodes on the first substrate of the plasma cell.

In the method for producing the picture display device of the present invention, the first substrate or the plate member has on its facing surface a plurality of discharge electrodes formed for extending substantially parallel to one another. The plate member or the first substrate also has on its facing surface a plurality of address electrodes formed for extending substantially at right angle to the discharge electrodes, the plate member or the first substrate having on its facing surface a plurality of phosphor elements deposited thereon.

In the method for producing the picture display device of the present invention, the first substrate or the plate member has on its facing surface a plurality of discharge electrodes for extending substantially parallel to one another. The plate member of the first substrate has phosphor elements deposited on its facing surface. The hermetically sealed assembly has a plurality of address electrodes formed between the first substrate and the plate member for extending substantially at right angles to the discharge electrodes.

In the method for producing the picture display device of the present invention, the first substrate or the plate member has on its facing surface a plurality of first electrodes formed for extending substantially parallel to one another. The plate member or the first substrate has on its facing surface a plurality of second electrodes formed for extending substantially at right angle to the first electrodes. The plate member or the first substrate has on its facing surface a plurality of phosphor elements deposited on its major surface.

Specifically, with the method for producing the picture display device of the present invention, a glass tube is placed in an opening area of the through-hole formed at a pre-set position of a first substrate of a hermetically sealed assembly comprised of the first substrate and a plate element spaced apart a pre-set distance from the first substrate, with the perimetral area of the resulting assembly being sealed with a sealant to provide a hermetically sealed assembly. A calcined solid frit held by a holding member is placed in the vicinity of a bond of the glass tube to the through-hole in the glass tube, and the inside of the sealed assembly is evacuated via the glass tube. A pre-set portion of the glass tube is radially compressed to form a constricted portion, with the calcined solid frit being left between the constricted portion and the opening area of the through-hole. The calcined solid frit is moved to the constricted portion of the glass tube. A gas is then charged into the gap between the first substrate and the plate member via the glass tube and the calcined solid frit in the constricted portion in the glass tube is melted and solidified for hermetically sealing the constricted portion. This effectively seals the glass tube by stopping with the frit material. There is no necessity of sealing the glass tube itself such that it becomes possible to cope with an elevated gas pressure in the hermetically sealed assembly which may be as high as one atmosphere. This sealing is superior in reliability. With the manufacturing method for the picture display device according to the present invention, the glass tube can be sealed easily to assure optimum mass-producibility.

Also with the manufacturing method for the picture display device according to the present invention, high sealing reliability is assured without affecting the inside of the hermetically sealed assembly even if unneeded portions of the glass tube are cut off after melting and solidifying the calcined solid frit for hermetically sealing the constricted portion.

BEST MODE FOR CARRYING OUT THE INVENTION

Figure 1:
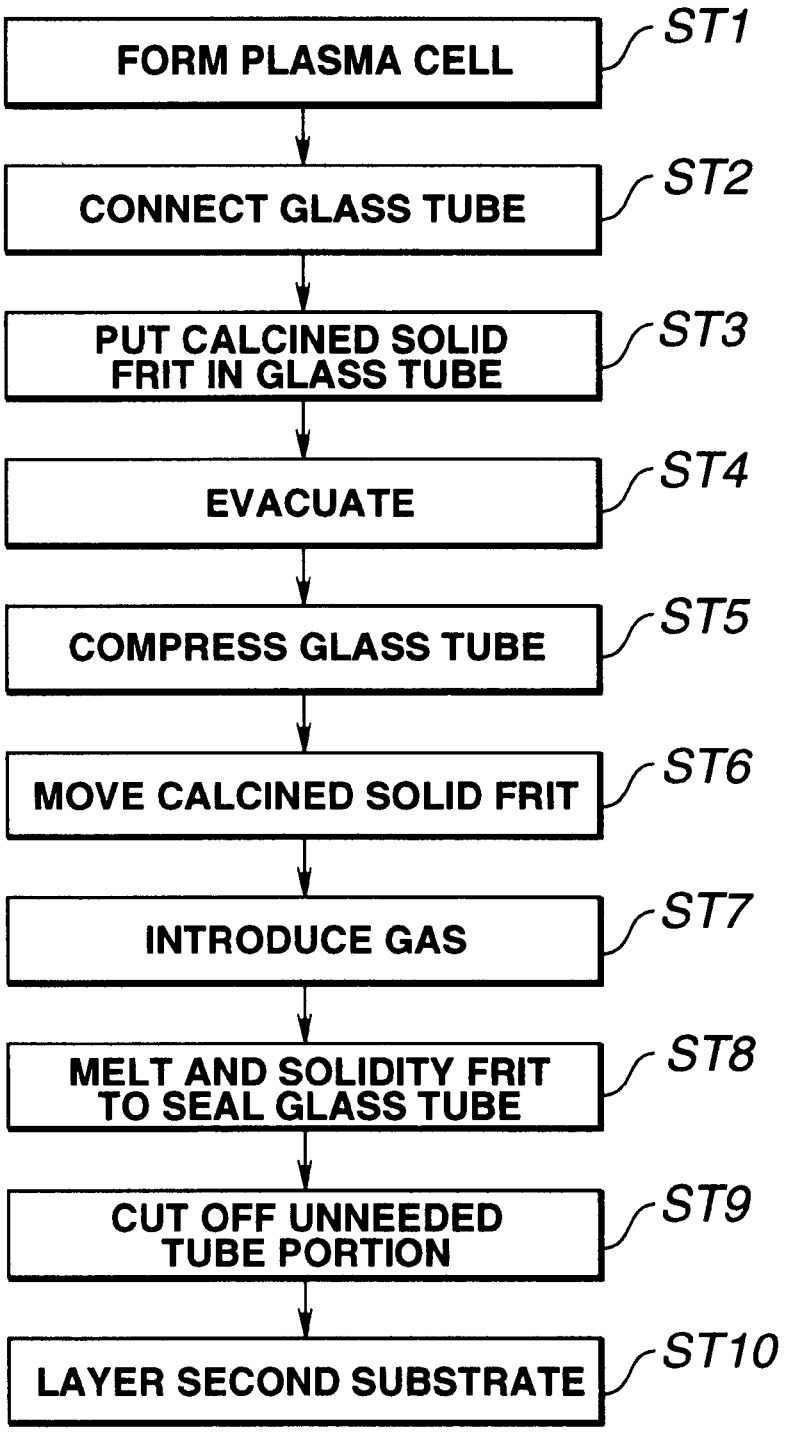
FIG. 1 is a flowchart showing the manufacturing method of a picture display device embodying the present invention.

Referring to the drawings, preferred embodiments of the present invention will be explained in detail.

First, the present invention as applied to a manufacturing method for a picture display device adapted for driving a liquid crystal layer using a discharge plasma is explained.

Figure 2:
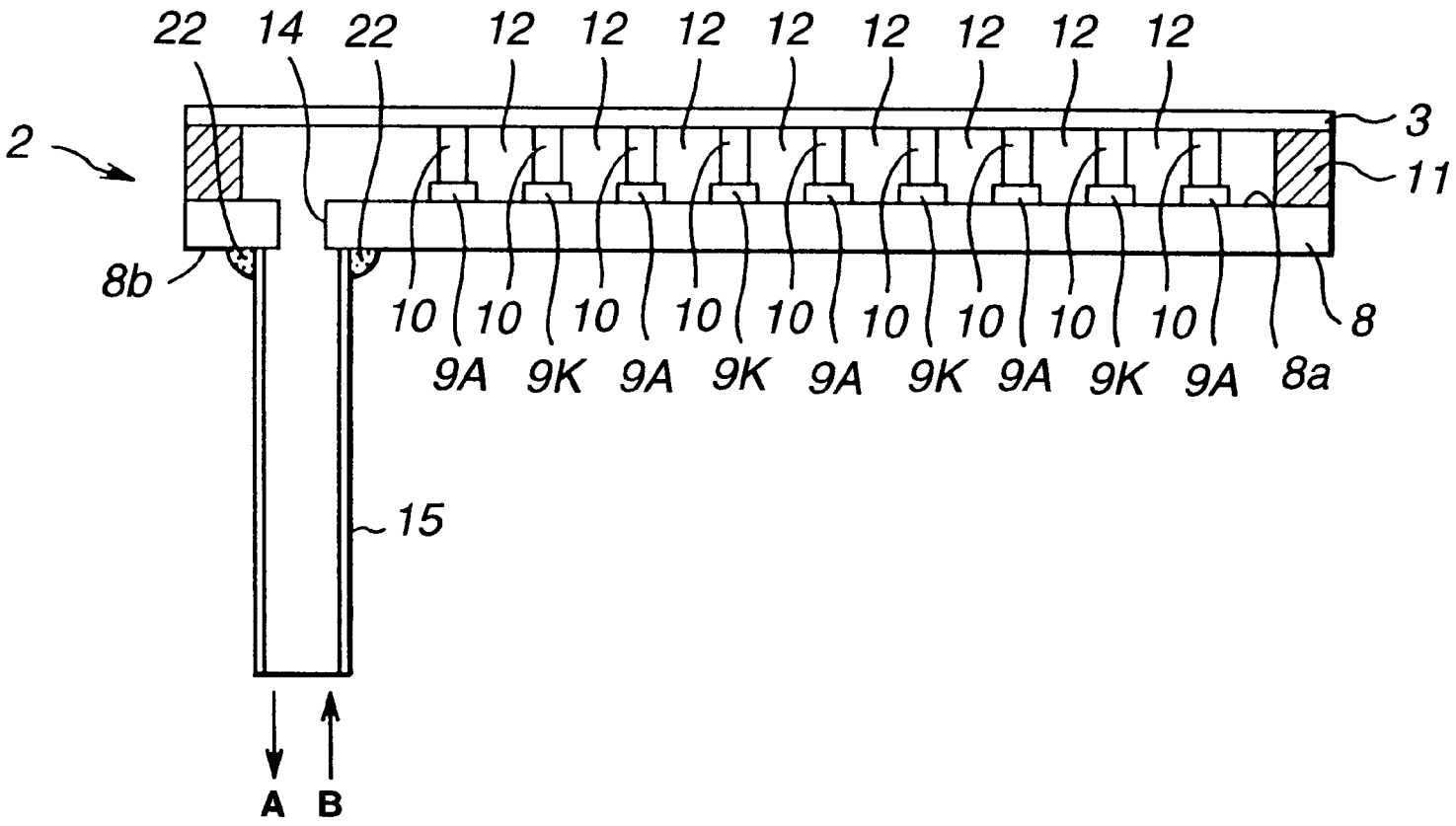
FIG. 2 is a cross-sectional view showing the process for connecting a glass tube to the plasma cell.

In the manufacturing method for the present embodiment of the picture display device, a plasma cell is first formed (ST1). That is, a plasma cell 2 is prepared, as shown in FIG. 1. The plasma cell 2 includes a first substrate 8 and a thin sheet of a dielectric material 3 placed on the first substrate 8 at a pre-set distance therefrom by partitioning wall sections 10 and has its peripheral portion sealed with a frit sealant 11, as shown in FIG. 2. The first substrate 8 has a through-hole 14. at a pre-set portion and plural anode electrodes 9A and cathode electrodes 9K on its major surface 8*a*.

In the plasma cell 2, plasma electrodes (discharge electrodes) are arranged on the major surface 8*a* which is the inner major surface of the first substrate 8, as described above. That is, the anode electrodes 9A and the cathode electrodes 9K, formed in parallel line configuration, are alternately formed in parallel in a pre-set direction at a pre-set separation from one another to constitute a set of discharge electrodes.

At the mid portions of the upper sides of the anode electrodes 9A and the cathode electrodes 9K are formed the partitioning wall sections 10 of pre-set widths extending along the electrodes, with the gap between the first substrate 8 and the thin dielectric sheet 3 delimiting discharge channels 12. The upper sides of the partitioning wall sections 10 are caused to bear against the lower surface of the thin dielectric sheet 3 to maintain a constant gap between the first substrate 8 and the thin dielectric sheet 3.

The thin dielectric sheet 3 is formed of a thin sheet glass and operates as a capacitor. Thus, for assuring a sufficient electrical coupling between an electro-optical display cell as later explained and the plasma cell 2 and for suppressing two-dimensional expansion of electrical charges, the thickness of the thin dielectric sheet 3 needs to be reduced to as small a value as possible, specifically to a magnitude of the order of 50 $\mu$m.

Around the periphery of the first substrate 8, there is placed a frit sealant 11 of a low melting glass material for interconnecting the first substrate 8 and the thin dielectric sheet 3 in a hermetically sealed condition so that the plasma cell 2 operates as a hermetically sealed spacing. In this hermetically sealed spacing, which is the gap between the first substrate 8 and the thin dielectric sheet 3, an ionizable gas is sealed in a subsequent step. The sealing gas may, for example, be an inert gas or a mixture of the inert gases.

Then, a glass tube connection step (ST2) is carried out, as shown in FIG. 1. That is, a glass tube 15 is secured in an opening of a major surface 8*b* of the first substrate 8 of the plasma cell 2 opposite to the major surface 8*a* on which the anode electrodes 9A and the cathode electrodes 9K are formed. At this time, the glass tube 15 is secured to the first substrate 8 by a bond 22 formed by a frit material. At this time point, both ends of the glass tube 15 are opened. The glass tube 15 has an internal diameter larger than the opening diameter of the through-hole 14.

Figure 3:
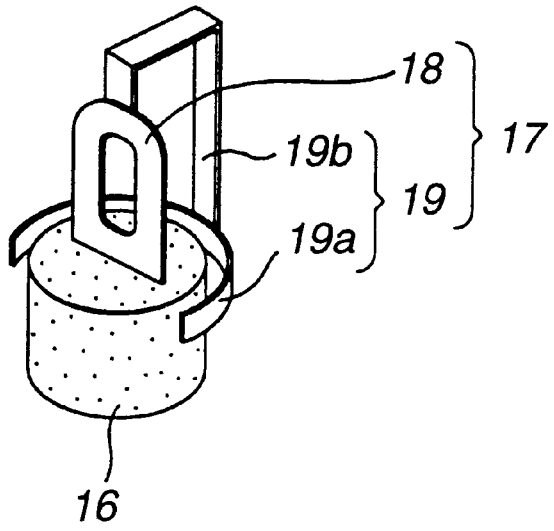
FIG. 3 is a perspective view showing the process of connecting the glass tube to a plasma cell.

Then, a calcined solid frit is placed in the glass tube 15 (ST3). This calcined solid frit may be comprised of a substantially columnar-shaped calcined solid frit 16 held by a holding member 17, as shown in FIG. 3. The calcined solid frit, which may be of any suitable shape if it can be inserted into the glass tube 15, is preferably small-sized and yet is sufficient in volume.

The holding member 17 is made up of a metal plate 18 partially introduced into the calcined solid frit 16 for holding the calcined solid frit 16 and a securing spring 19 connected to the metal plate 18 for holding it in the glass tube. This securing spring 19 is made up of a substantially semi-circular spring portion 19*a* substantially fitting the inner wall surface of the glass tube and a substantially U-shaped frame portion 19*b* connected to the mid portion of the spring portion 19*a,* with the distal end of the frame portion 19*b* carrying the metal plate 18. With the present securing spring 19, the frame portion 19*b,* metal plate 18 and the calcined solid frit 16 are held against the inner wall of the glass tube under the spring force of the flexed section of the spring portion 19*a*.

Figure 4:
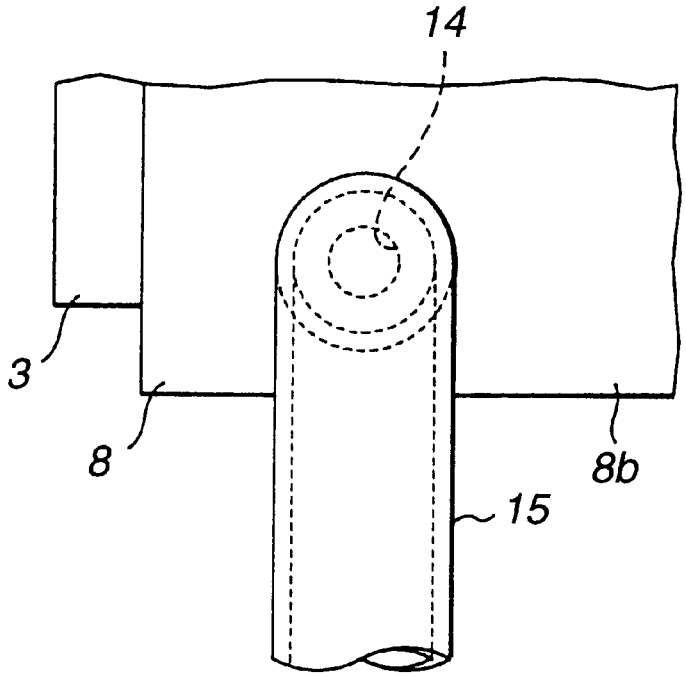
FIG. 4 is a perspective view showing an example of a calcined solid frit held by a holding member.
Figure 5:
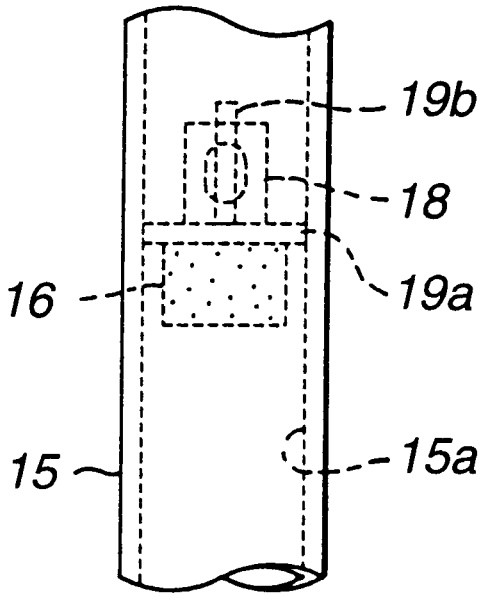
FIG. 5 is an enlarged side view schematically showing the process of arraying calcined solid frit in a glass tube.

That is, if the calcined solid frit 16 is arranged in the glass tube 15 connected to the opening area of the through-hole 14 in the major surface 8*b* of the first substrate 8, as shown schematically in FIG. 4, the calcined solid frit 16, held by the metal plate 18 secured to the distal end of the frame portion 19*b,* is held along an inner wall section 15*a* of the glass tube 15 by the spring force of the flexed portion of the spring portion 19*a* for holding the calcined solid frit 16 within the glass tube 15, as shown in FIG. 5.

Figure 6:
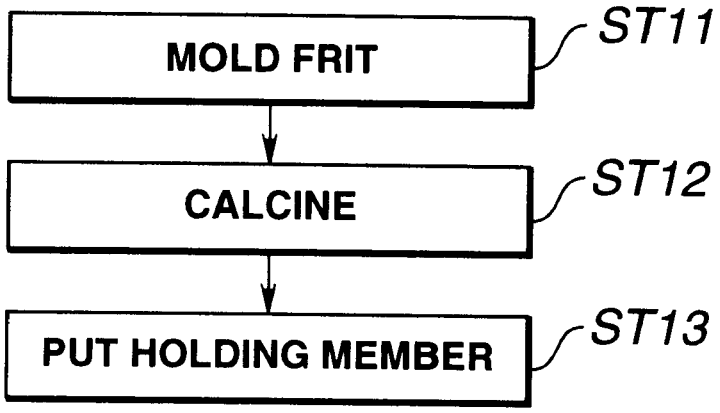
FIG. 6 is a flowchart showing the manufacturing method of the calcined solid frit.

The calcined solid frit 16 is produced as follows: That is, frit molding ST11 is carried out, as shown in FIG. 6. That is, a minor amount of a solvent containing a binder is mixed with frit powders to prepare frit powders which are charged into a metal mold of a pre-set shape and pressurized to a pre-set shape. Then, calcination as shown in FIG. 6 (ST12) is carried out. That is, the frit molded as described above is calcined under conditions of, for example, 390° C. for 10 minutes to obtain a calcined solid frit. The calcined solid frit mounting step (ST13) is then carried out, as shown in FIG. 6. Specifically, the metal plate 18 of the previously prepared holding member 17 is heated by heating means, such as a small-sized burner, and is brought into contact with the calcined solid frit 16. The contact portions are melted and fused together and solidified to complete an assembly.

Then, the inside of the plasma cell 2 is evacuated by evacuation step (ST4), as shown in FIG. 1. That is, the discharge channels 12 in the plasma cell 2 are evacuated via the glass tube 15 as indicated by arrow A in FIG. 2. In FIG. 2, the calcined solid frit is not shown for clarity.

Figure 7:
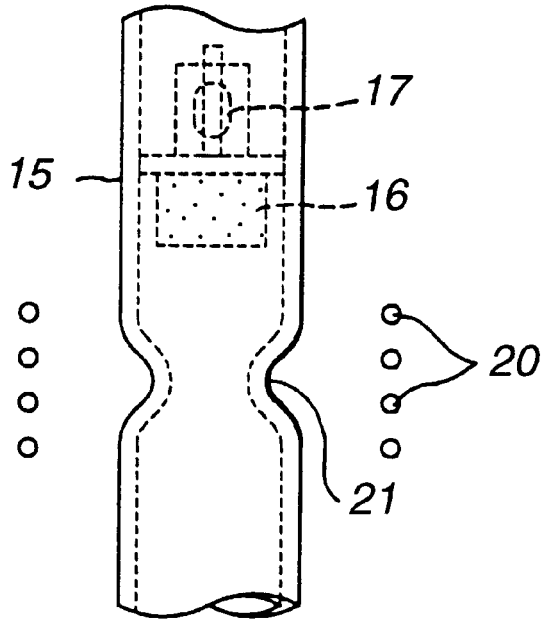
FIG. 7 is an enlarged side view schematically showing the glass tube compression process.

Then, the glass tube 15 is compressed (ST5) in FIG. 1. That is, the outer periphery of the glass tube 15 is encircled by a heater 20, such as a heater wire, at a pre-set position of the glass tube 15 such that the calcined solid frit 16 held by the holding member 17 will be located below the calcined solid frit, that is at a pre-set position of the glass tube 15 such that the calcined solid frit 16 will be located intermediate between the opening portion of the through-hole, herein not shown, and the pre-set position. The heated portion of the glass tube 15 is softened and, since the inside of the glass tube 15 is kept in vacuum, the glass tube 15 is compressed radially as shown in FIG. 7 to form a constricted portion 21.

Figure 8:
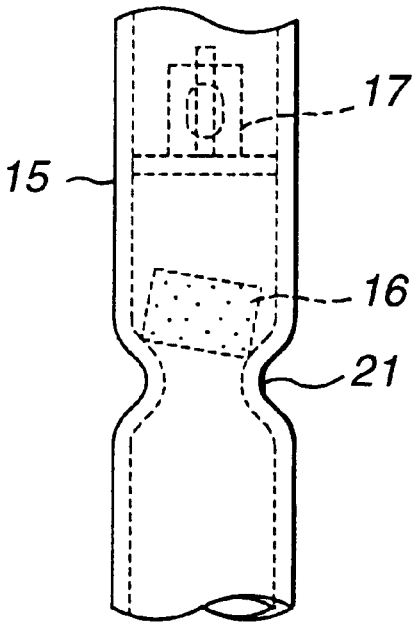
FIG. 8 is a schematic side view showing an example of the state of holding the calcined solid frit by a constricted portion of the glass tube.

The calcined solid frit is then moved (ST6) as shown in FIG. 1. that is, the metal plate 18 of the holding member 17 holding the calcined solid frit 16 is heated by high-frequency heating for melting only the connected portion of the metal plate 18 with the calcined solid frit 16, for dismounting the calcined solid frit 16 from the metal mold. This causes the calcined solid frit 16 disengaged from the holding member 17 to descend in the glass tube 15, as shown in FIG. 8 so as to be caught by and held on the constricted portion 21.

The ionizable gas is then charged into the plasma cell 2 (ST7) as shown in FIG. 1. That is, the ionizable gas to be charged into the discharge channels 12 is charged as indicated by arrow B in FIG. 2, in which the calcined solid frit again is not shown for clarity.

Figure 9:
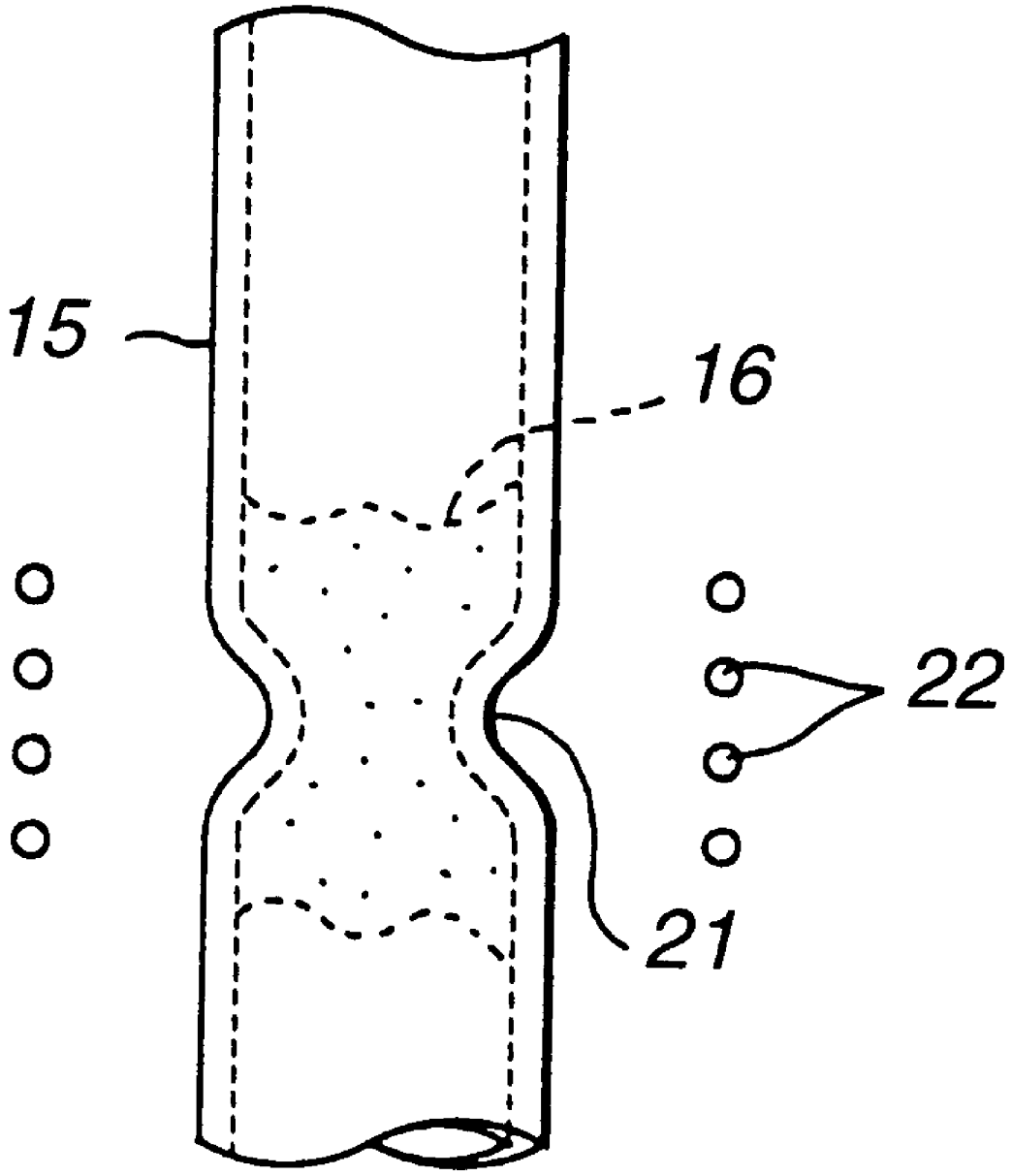
FIG. 9 is an enlarged side view schematically showing the melting solidifying process of the calcined solid frit.

The calcined solid frit melting solidifying glass tube sealing step (ST8) is carried out for melting and solidifying the calcined solid frit 16 for sealing the glass tube 15, as shown in FIG. 1. That is, the heater 20 is placed around the periphery of the glass tube 15 for heating the constricted portion 21 as shown schematically in FIG. 9. This heating may be carried out at 430° to 450° C. for about two minutes. This melts the calcined solid frit 16 caught and held on the constricted portion 21 as shown in FIG. 9 to stop up the constricted portion 21. If the calcined solid frit 16 is solidified in this state, the constricted portion 21 of the glass tube 15 is hermetically sealed by the calcined solid frit 16.

Figure 10:
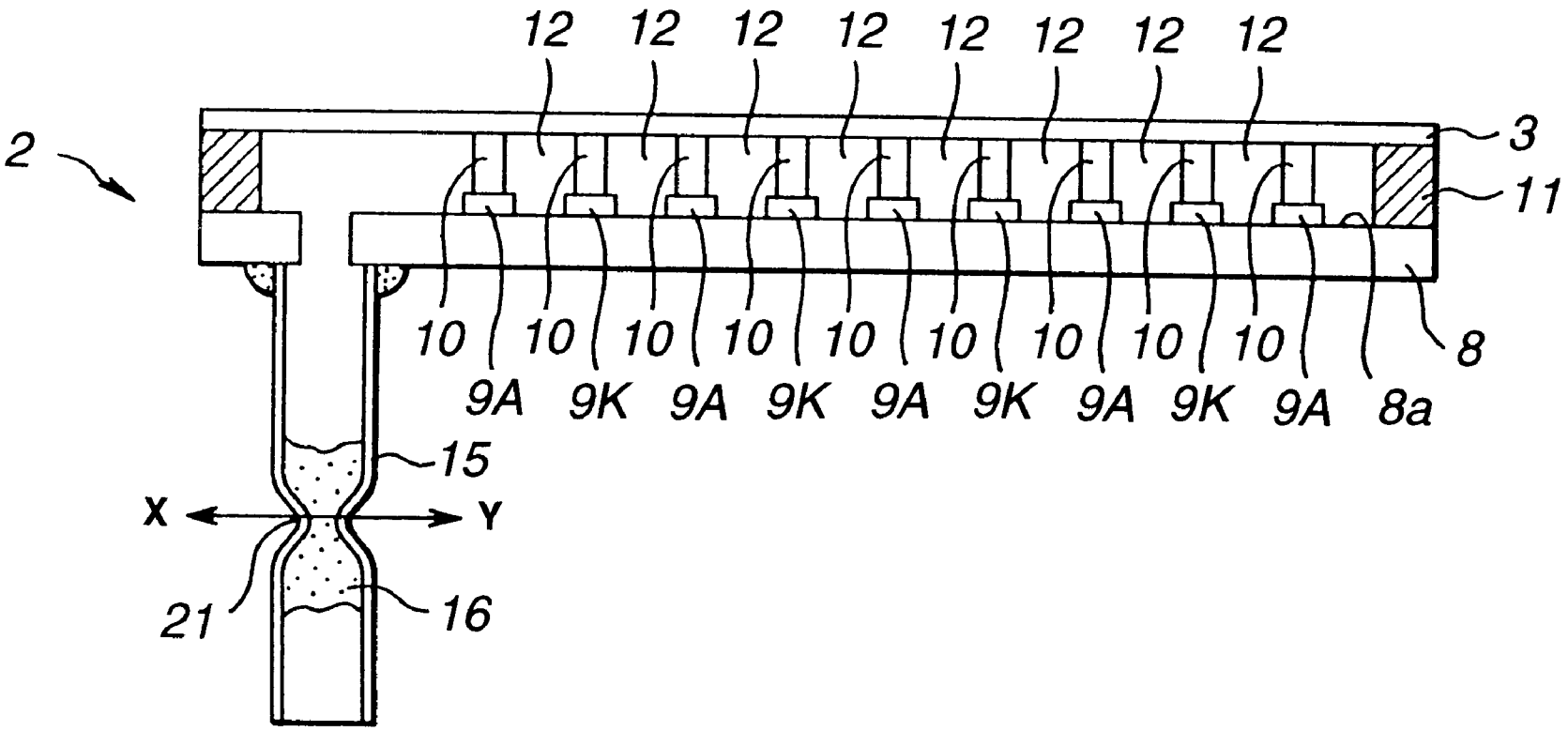
FIG. 10 is a cross-sectional view showing the process of cutting off a glass tube.

The unneeded glass tube cutting off step (ST9) is then carried out for cutting off the unneeded portion of the glass tube 15, as shown in FIG. 1. That is, the glass tube 15 is severed at the constricted portion 21, as shown at X-Y in FIG. 10.

Finally, the second substrate layer forming step (ST10) is then carried out for layering a second substrate on the thin dielectric sheet 3 of the plasma cell 2 via a liquid crystal layer, as shown in FIG. 1. That is, a second substrate 4 is layered on the thin dielectric sheet 3 via a liquid crystal layer 7 to complete a picture display device of a flat panel structure having the electro-optical display cell 1 and the plasma cell 2 layered together via the liquid crystal layer 7. The second substrate 4 has, on its major surface 4*a* as a facing surface to the first substrate 8, a plurality of data electrodes 5 extending substantially at right angles to the anode electrodes 9A and the cathode electrodes 9K on the first substrate 8.

Figure 11:
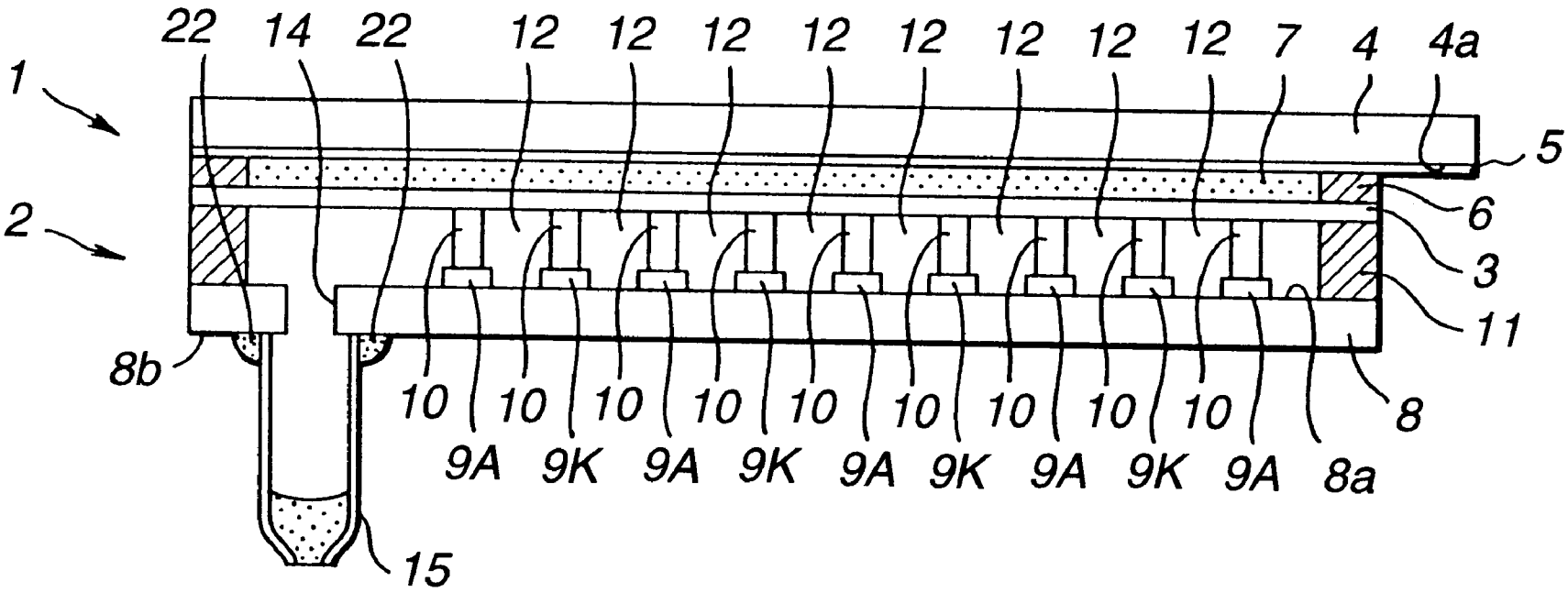
FIG. 11 is an enlarged schematic cross-sectional view showing an example of a picture display device manufactured by the manufacturing method for the picture display device embodying the present invention.
Figure 12:
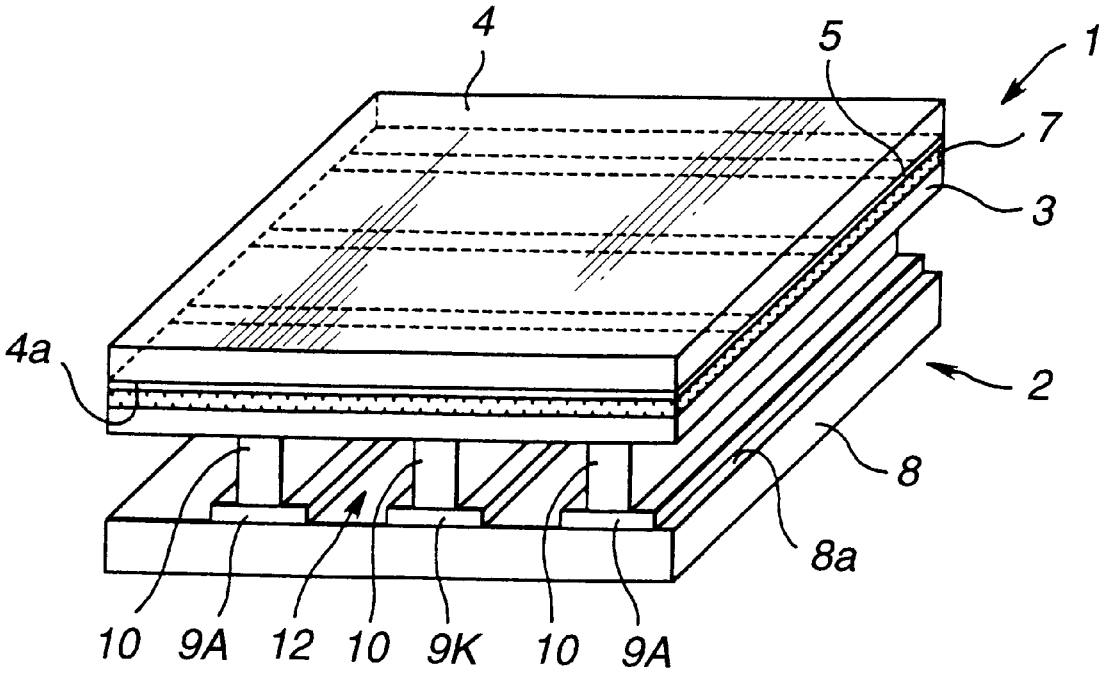
FIG. 12 is a enlarged schematic perspective view of a picture display device manufactured by the manufacturing method for the picture display device embodying the present invention.

The electro-optical display cell 1 is formed by the second substrate 4 on the inner major surface 4*a* of which plural parallel line-shaped data electrodes 5 are formed side-by-side in a pre-set arraying direction, with a pre-set interval in-between, as shown in FIGS. 11 and 12. This pre-set arraying direction of the data electrodes 5 is the column direction.

On the mid portions of the upper surfaces of the anode electrodes 9A and the cathode electrodes 9K are formed plural partitioning wall sections 10 at a pre-set width for extending along the electrodes.

The second substrate 4 of the electro-optical display cell 1 is connected to the thin dielectric sheet 3 via spacer 6.

Between the second substrate 4 and the thin dielectric sheet 3 is charged the liquid crystal as the electro-chemical material to form the liquid crystal layer 7. The electro-optical material may be any suitable material other than the liquid crystal. The gap between the second substrate 4 and the thin dielectric sheet 3 may, for example, be 4 to 10 $\mu$m and is uniform over the entire surface area.

That is, the second substrate 4 is layered on the plasma cell 2 via the liquid crystal layer 7 as the electro-optical material.

The result is that the discharge channels 12 (plasma chambers) separated from one another by the partitioning wall sections 10 are formed side-by-side in the column direction. That is, the discharge channels 12 are formed for extending at right angles to the data electrodes 5.

Figure 13:
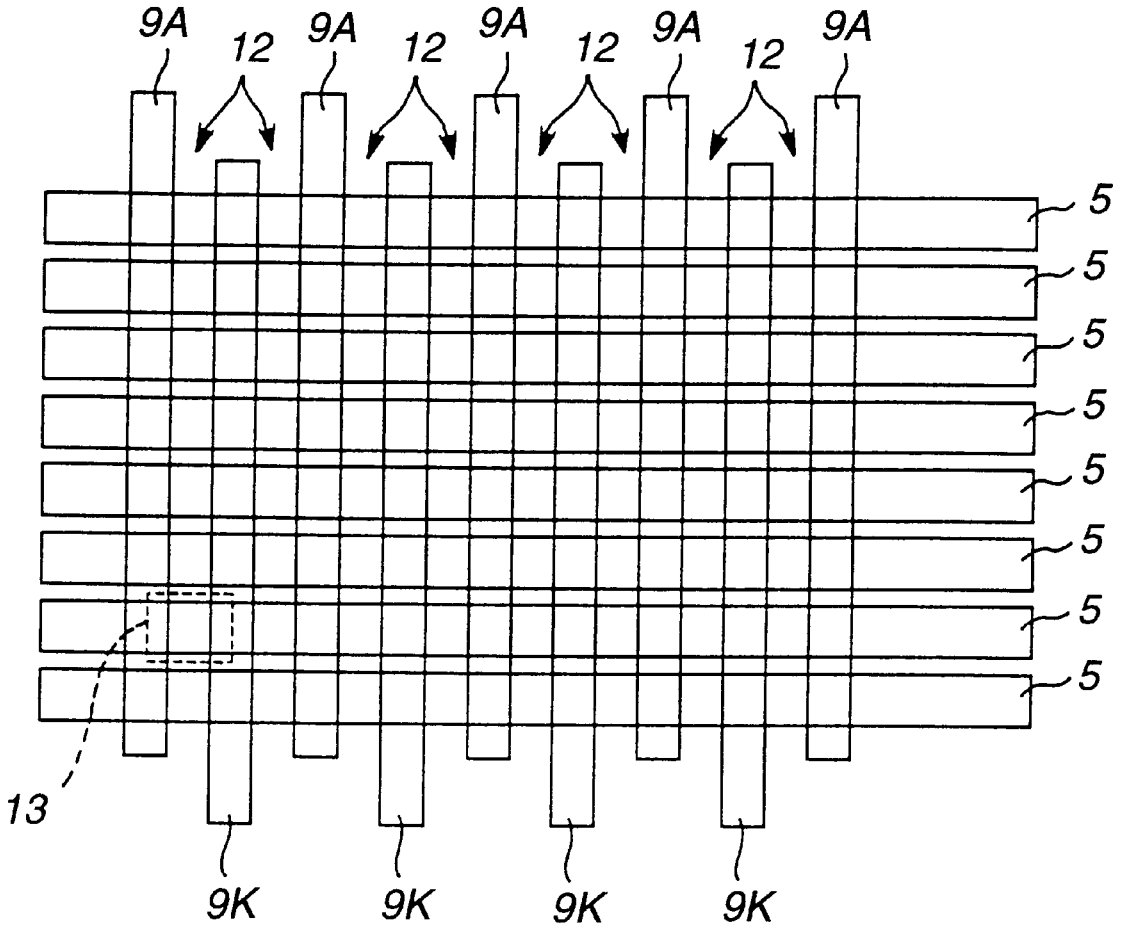
FIG. 13 is a schematic view showing a data electrode, plasma electrode and a discharge channel of the picture display device.

Thus, the data electrodes 5 operate as column driving units, whilst the discharge channels 12 operate as the row driving units. The points of intersection are in register with pixels 13, as shown in FIG. 13.

If, in the above-described picture display device, a pre-set voltage is applied across the anode electrodes 9A and the cathode electrodes 9K defining the pre-set discharge channels 12, the gas sealed in the discharge channels 12 is ionized to produce plasma discharge to maintain the anode potential.

If, in this state, the data voltage is applied across the data electrodes 5, a data voltage is written in the portions of the liquid crystal layer 7 in register with the plural pixels arrayed in the column direction in association with the discharge channels 12 in which occurred the plasma discharge.

On termination of the plasma discharge, the discharge channels 12 are at a floating potential such that the data voltage written in the portions of the liquid crystal layer 7 in register with the pixels 13 is held until the next writing period (for example, until after one field or one frame). In this case, the discharge channels 12 operate as a sampling switch, with the portions of the liquid crystal layer 7 of the respective pixels operating as sampling capacitors.

The liquid crystal is actuated by the data voltage written in the liquid crystal layer 7 so that display is achieved on the pixel basis. Thus, by sequentially scanning the discharge channels 12 producing the plasma discharge as described above and by applying the data voltage in synchronism with the scanning, the liquid crystal layer 7 is driven as in the active matrix address system for displaying a two-dimensional picture.

In producing the picture display device of the present embodiment, the calcined solid frit 16 held by the holding member 17 is placed in the glass tube 15 used for evacuation and gas charging of the plasma cell 2. The inside of the plasma cell 2 is then evacuated via the glass tube 15 and a pre-set portion of the glass tube 15 is radially compressed to form the constricted portion 21. The calcined solid frit 16 is left in the space between the constricted portion 21 and the opening portion of the through-hole 14 in the first substrate 8 of the plasma cell 2. The calcined solid frit 16 then is disengaged from the holding member 17 so as to be moved to the constricted portion 21 of the glass tube 15. After charging the gas in the plasma cell 2 via the glass tube 15, the calcined solid frit 16 in the constricted portion 21 of the glass tube 15 is melted and solidified to hermetically seal the constricted portion 21. Since the glass tube 15 is substantially sealed by the frit material, there is no necessity of sealing the glass tube 15 itself such that it becomes possible to cope with the internal gas pressure in the plasma cell 2 which is as high as about 1 atmospheric pressure. With the present manufacturing method, the internal pressure in the plasma cell 2 can be raised as long as the strength of the glass tube 15 permits. Moreover, sealing may be achieved to high reliability in this manner to assure high operational reliability of the picture display device. With the above-described manufacturing method of the picture display device, the glass tube 15 can be sealed easily to assure satisfactory mass-producibility and optimum productivity.

Also, with the manufacturing method of the picture display device of the present embodiment, the inside of the plasma cell 2 remains unaffected even if the unneeded portion of the glass tube 15 is cut off after melting and solidifying the calcined solid frit 16 for hermetically sealing the constricted portion 21, thus assuring operational reliability of the produced picture display device. The temperature for melting the calcined solid frit 16 can be sufficiently achieved by heating by a heater wire and hence is constant. Any resulting variation in the internal gas pressure can be corrected by calculations.

Figure 14:
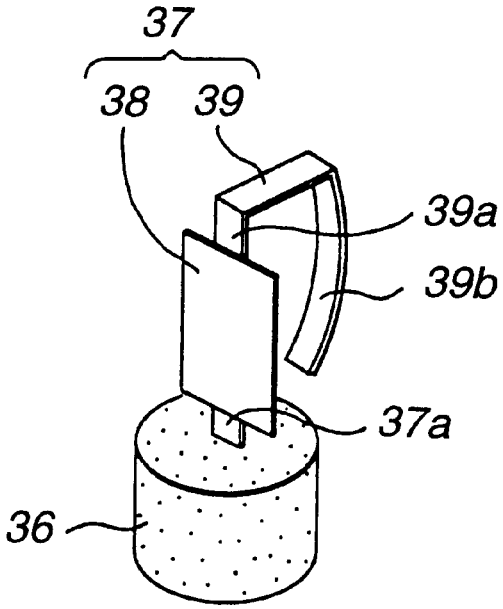
FIG. 14 is a perspective view showing another example of the calcined solid frit held by the holding member.
Figure 15:
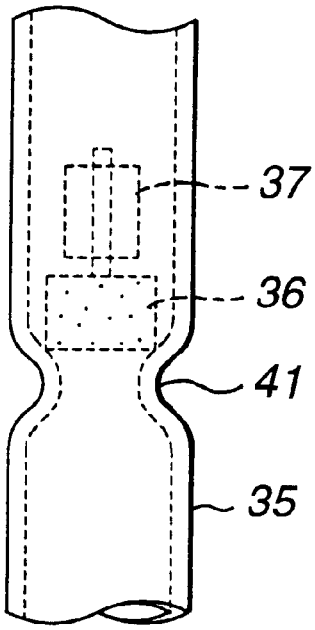
FIG. 15 is a schematic side view showing another example of the state of holding the calcined solid frit by a constricted portion of the glass tube.

In the above-described embodiment, the holding member comprised of a metal plate and the securing spring is used for holding the calcined solid frit. Alternatively, such a holding member 37 may be used which is comprised of a ferromagnetic plate 38, having a terminal lug 37*a* inserted into a calcined solid frit 36, and a substantially U-shaped securing spring 39, as shown in FIG. 14. In this holding member 37, the ferromagnetic plate 38 is secured to an end 39*a* of the securing spring 39, with the distal opposite end 39*b* of the securing spring 39 being warped towards the ferromagnetic plate 38. That is, the elastic flexed portion of the securing spring 39 operates for separating the ferromagnetic plate 38 away from the opposite end 39*b* of the securing spring 39.

If the calcined solid frit 36 is placed in the glass tube, the ferromagnetic plate 38 and the opposite end 39*b* of the securing spring 39 are thrust against the inner wall surface of the glass tube by the elastic force of the securing spring 39 operating for spacing the ferromagnetic plate 38 and the opposite end 39*b* away from each other for holding the ferromagnetic plate 38 and the opposite end 39*b* in the glass tube.

For moving the calcined solid frit 36 to the constricted portion of the glass tube, it suffices if vibrations are applied by e.g., a electro-magnet to the ferromagnetic plate 38 for shifting the calcined solid frit 36 along with the holding member 37 by its own weight to the constricted portion 41 in the glass tube 35.

Of course, similar effects may be achieved by manufacturing the picture display device by the above-described manufacturing method using the calcined solid frit 36 held by the holding member 37.

Although the manufacturing method of the picture display device, in which the liquid crystal layer is driven using the discharge plasma has been explained in the above, the present invention can naturally be applied to the manufacture of the PDP.

Referring to the drawings, an embodiment of the present invention in which the invention is applied to the manufacture of the PDP is explained.

The manufacturing method for the PDP is similar to that of the picture display device adapted for driving the liquid crystal layer using the discharge plasma. First, an embodiment of the present invention as applied to the manufacture of the AC type PDP is explained.

The manufacturing method for the PDP is similar to that for the picture display device adapted for driving the liquid crystal layer using the discharge plasma. The point of significant difference is the difference in the first substrate and a component used as the plate material.

Figure 16:
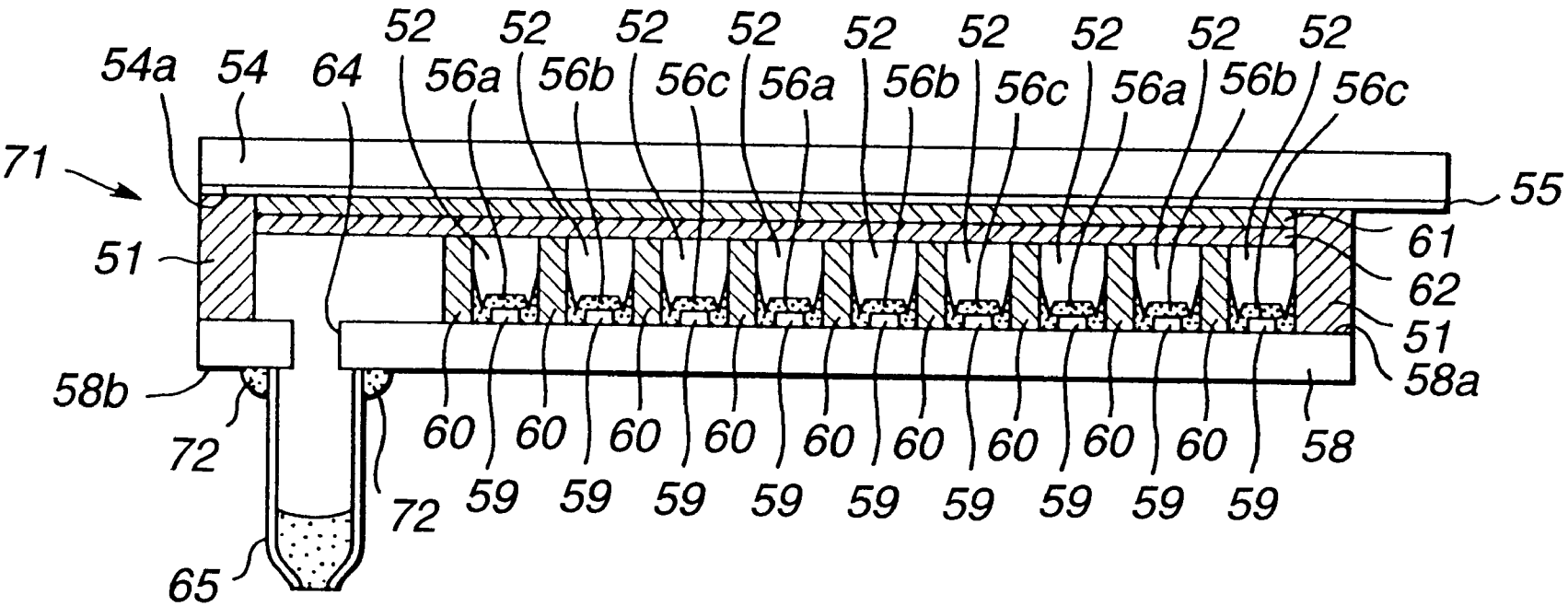
FIG. 16 is an enlarged schematic cross-sectional view showing another example of a picture display device manufactured by the manufacturing method for the picture display device embodying the present invention.
Figure 17:
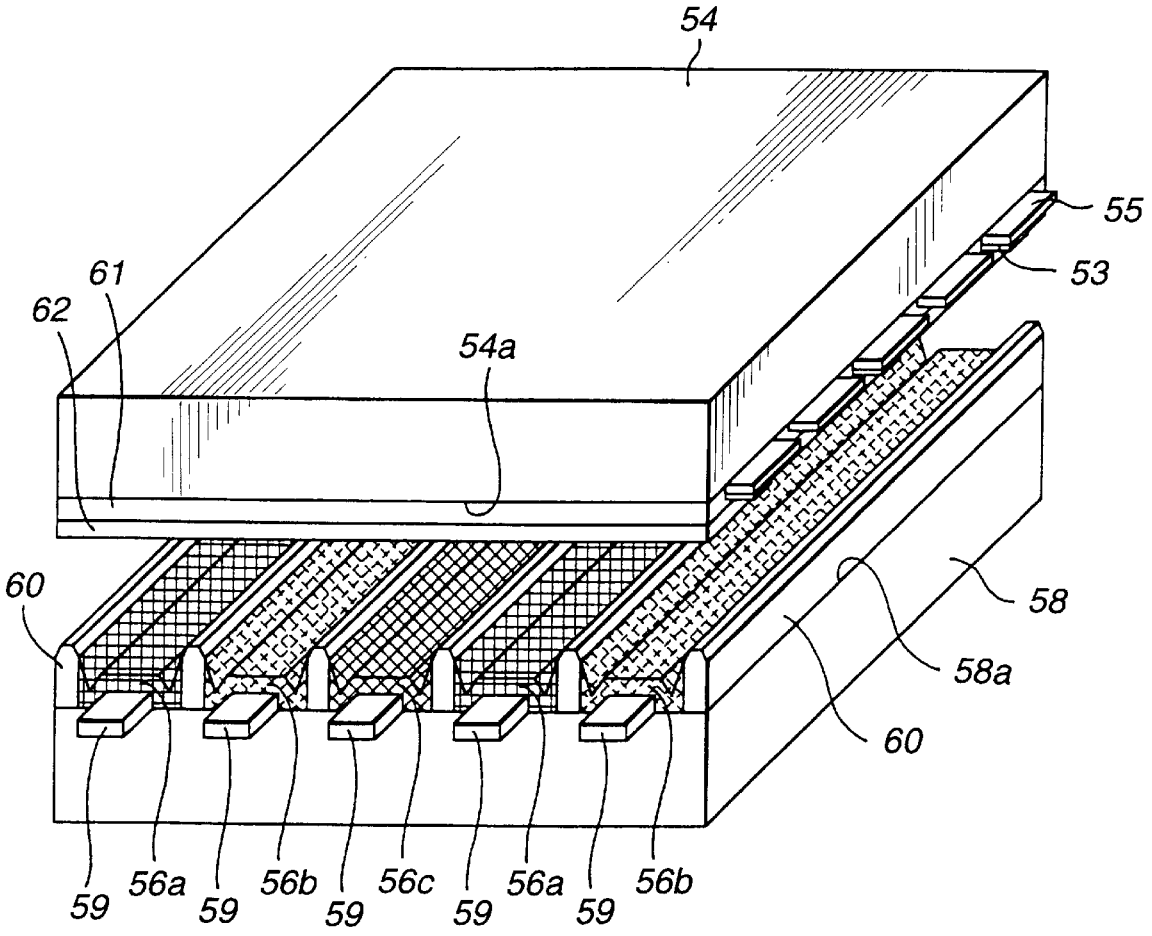
FIG. 17 is a schematic exploded perspective view showing the picture display device of FIG. 16.
Figure 18:
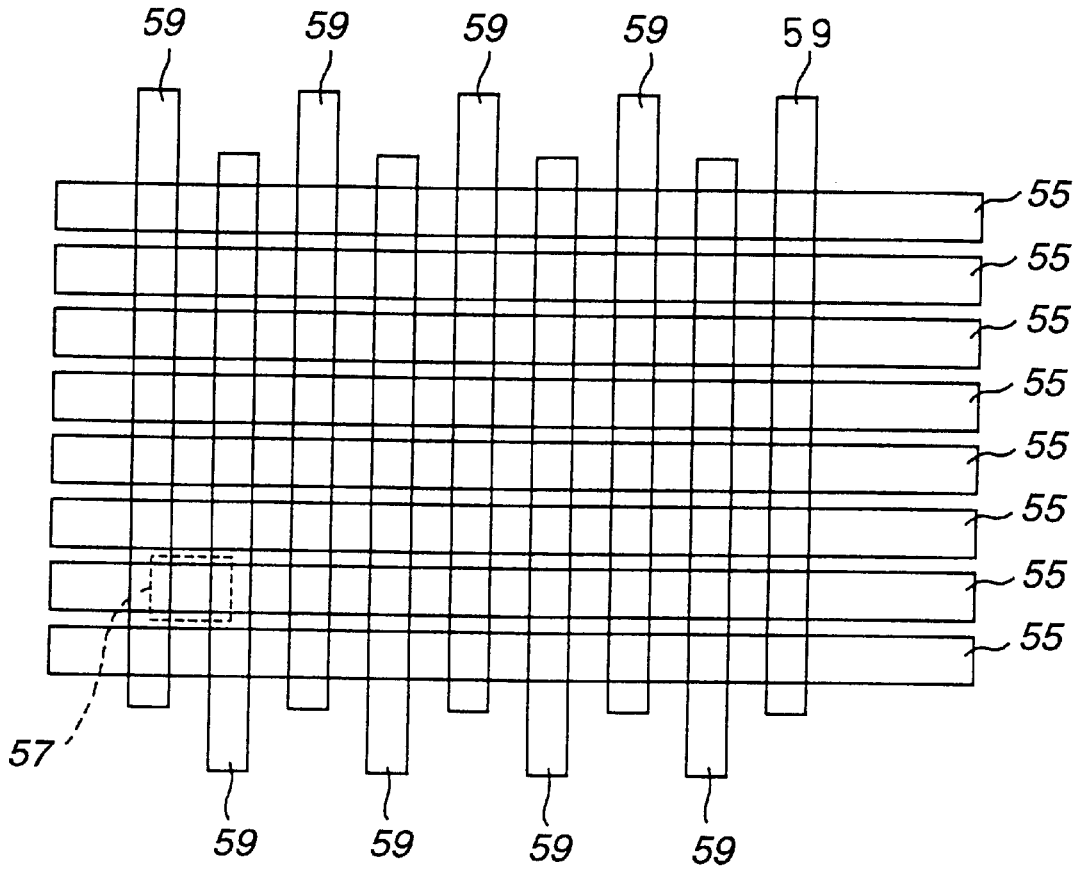
FIG. 18 is a schematic view showing a display electrode, an address electrode and a pixel of the picture display device.

Referring to FIGS. 16 and 17, the AC type PDP uses, as the first substrate, a first substrate 58 having, on its major surface 58*a,* as a facing surface, plural parallel line-shaped address electrodes 58 at a pre-set interval for extending in a pre-set direction. On the first substrate 58, there are formed line-shaped partitioning wall sections 60 between the neighboring address electrodes 59 for extending along the electrodes 59, so that there are formed spacing sections delimited by the partitioning wall sections 60 in register with the address electrodes 59. Also, on the first substrate 58, phosphor elements 56*a,* 56*b,* 56*c* are sequentially repeatedly arrayed for overlying the address electrodes 59. These phosphor elements 56*a,* 56*b,* 56*c* may be colored in red, green and blue, respectively. In the first substrate 58, a through-hole 64 is formed so as to clear the address electrodes 59 or the partitioning wall sections 60.

As the plate member, a second substrate 54, on the facing major surface 54*a* of which plural display electrodes 55 are formed as discharge electrodes, is used. The display electrodes 55 are parallel line-shaped and are formed of a transparent electrically conductive material. On the second substrate 54 is also formed a bus electrode 53 for being layered on a portion of the display electrodes 55. The bus electrode 53 is not shown in FIG. 16 for clarity. There are also sequentially layered a dielectric layer 61 and a protective layer 62 for overlying the display electrodes 55 and the bus electrode 53.

For producing the AC type PDP, the first substrate 58 and the second substrate 54 are placed so that the major surfaces 58*a,* 54*a* face each other and so that the distal ends of the partitioning wall sections 60 are abutted against the surface of the protective layer 65. The perimeter of the resulting assembly is sealed by a frit sealant 61 to produce a hermetically sealed assembly 71. In this hermetically sealed assembly 71, there are delimited spacing sections 52 surrounded by the partitioning wall sections 60 and the protective layer 62 of the second substrate 54 in register with the address electrodes 59 of the first substrate 58.

A glass tube 65 is then is connected in an opening of the through-hole 64 in the major surface 58*b* of the first substrate 58 opposite to the major surface 58*a* as the facing surface by a bond 72 formed of a frit material.

A calcined solid frit is then placed in the glass tube 65 as in the above-described manufacturing method. Any of the above-mentioned materials may be used as the calcined solid frit.

The inside of the hermetically sealed assembly 71 is then evacuated via glass tube 65 and a pre-set portion of the glass tube 65 is then compressed as in the manufacturing method described above. The calcined solid frit is then moved to the pre-set position and the gas is charged into the inside of the hermetically sealed assembly 71.

The calcined solid frit is then melted and solidified for solidifying the glass tube 65 and the unneeded portion of the glass tube 65 is then cut off, as in the same manner as in the above-described manufacturing method, to complete the AC type PDP as shown in FIG. 16.

In the above-described AC type PDP, the display electrodes, operating as discharge electrodes, are formed in parallel line-shapes which are arrayed at a pre-set separation from one another and are formed side-by-side in a pre-set direction, such that electrical discharge occurs between neighboring display electrodes 55 in the in-plane direction. This arraying direction corresponds to the column direction. The address electrodes 59 are arrayed on the first substrate 58 in parallel line shapes which are spaced apart from one another in a pre-set direction, as shown in FIGS. 16 and 17. The arraying direction in this case corresponds to the row direction.

Thus, the display electrodes 5 and the address electrodes 59 operate as the column driving units and as the row driving units, respectively. The intersecting points of these two driving units correspond to pixels 57. A picture is formed by excitation of the phosphor elements 26*a,* 26*b* and 26*c* arrayed in the spacing sections 52 corresponding to these pixels.

Figure 19:
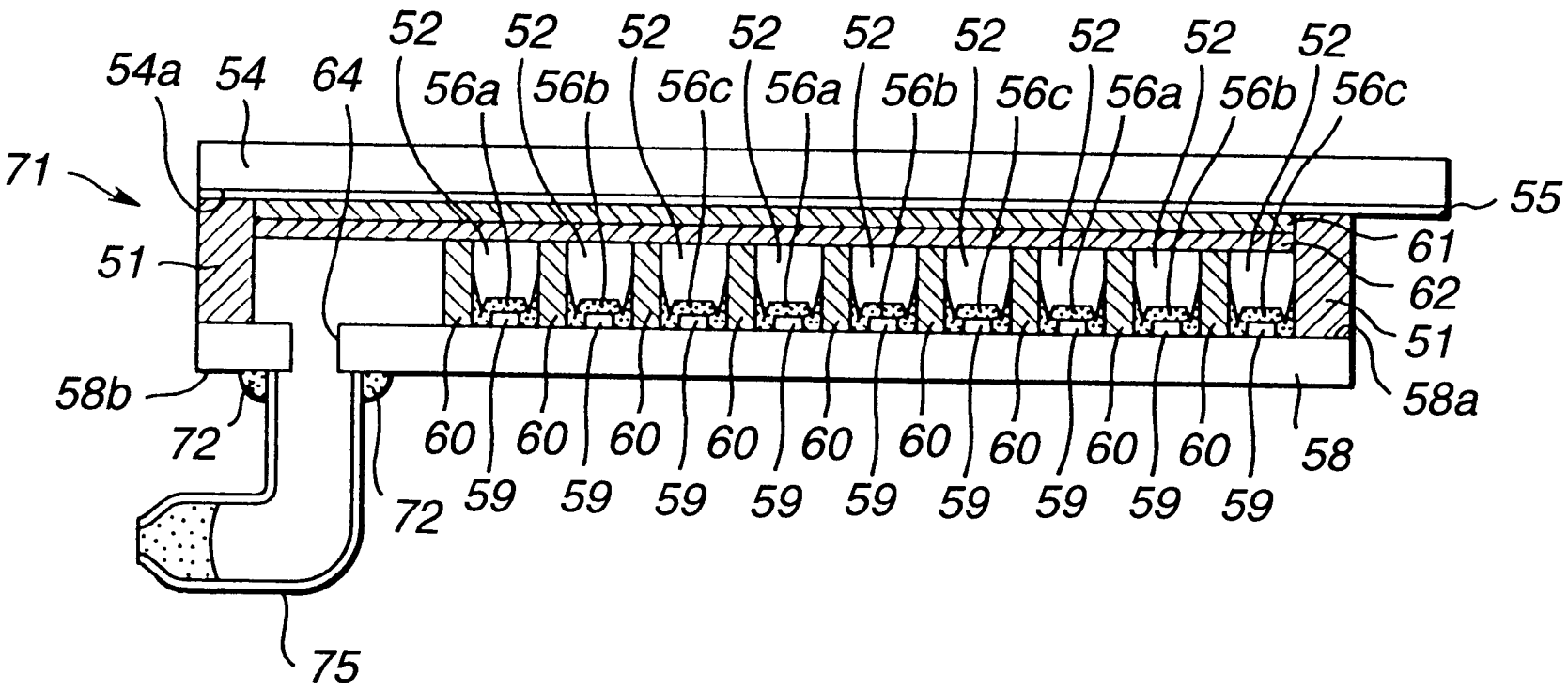
FIG. 19 is an enlarged schematic cross-sectional view showing a further example of a picture display device manufactured by the manufacturing method for the picture display device embodying the present invention.

Although the glass tube 65 used is of a linear shape, an L-shaped glass tube 75 as shown in FIG. 19 may also be used. Since the AC type PDP shown in FIG. 19 is configured similarly to the AC type PDP shown in FIG. 16, the same components are depicted by the same reference numerals and the corresponding description is omitted for clarity. If the glass tube 75 is L-shaped, the glass tube 75 takes up less space to render it possible to reduce the thickness of the PDP in its entirety.

For mass-producing the picture display devices of the present invention, several to tens of glass tubes are arrayed and interconnected side-by-side and the evacuation step and the gas introducing step are executed simultaneously for possibly improving the production efficiency. However, if the glass tubes are protruded perpendicularly from the display device, the spacing between the glass tubes arrayed side-by-side is increased to render the production device bulky in size because the size of the main body portions of the display device (substrates) act as a hindrance in interconnecting the glass tubes side-by-side. If the glass tubes 75 are arrayed in the L-shape, the display device in its entirety (substrates) is reduced in thickness, so that, if the glass tubes are arrayed and interconnected side-by-side, the spacing between the main body portions of the display device can be straightened to reduce the size of the production device to improve the production efficiency.

By forming the glass tube 75 in the L-shape, not only can the completed display device be reduced in thickness but also efficient production and cost reduction may be achieved. Of course, the bending angle of the glass tube is not limited to 90° and may be larger or smaller than 90° or plural bends may be provided in the tube if the structure is such as to permit application of the present invention.

In the above-described embodiment, there is used a first substrate on the facing surface of which address electrodes are formed in parallel with one another and the phosphor elements are deposited, whilst there is also used a plate member on the facing surface of which are formed plural discharge electrodes arrayed substantially in parallel with one another. Alternatively, the first substrate having plural discharge electrodes formed on its facing surface substantially parallel to one another and the plate member having address electrodes and phosphor elements formed on its facing surface may also be used.

There may also be used a first substrate having phosphor elements deposited on its facing surface and a plate member having plural discharge electrodes deposited substantially parallel to one another, with the address electrodes being formed substantially parallel to one another between the first substrate and the plate element in the hermetically sealed member.

Figure 20:
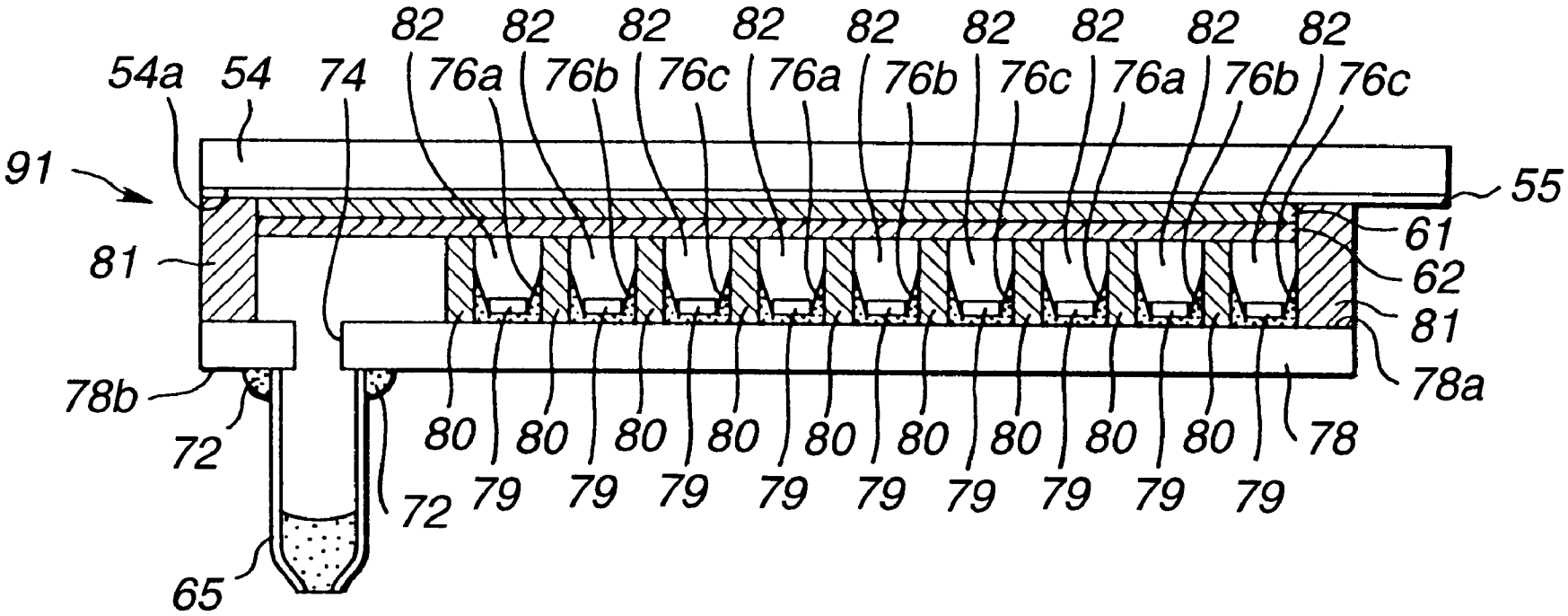
FIG. 20 is an enlarged schematic cross-sectional view showing a further example of a picture display device manufactured by the manufacturing method for the picture display device embodying the present invention.
Figure 21:
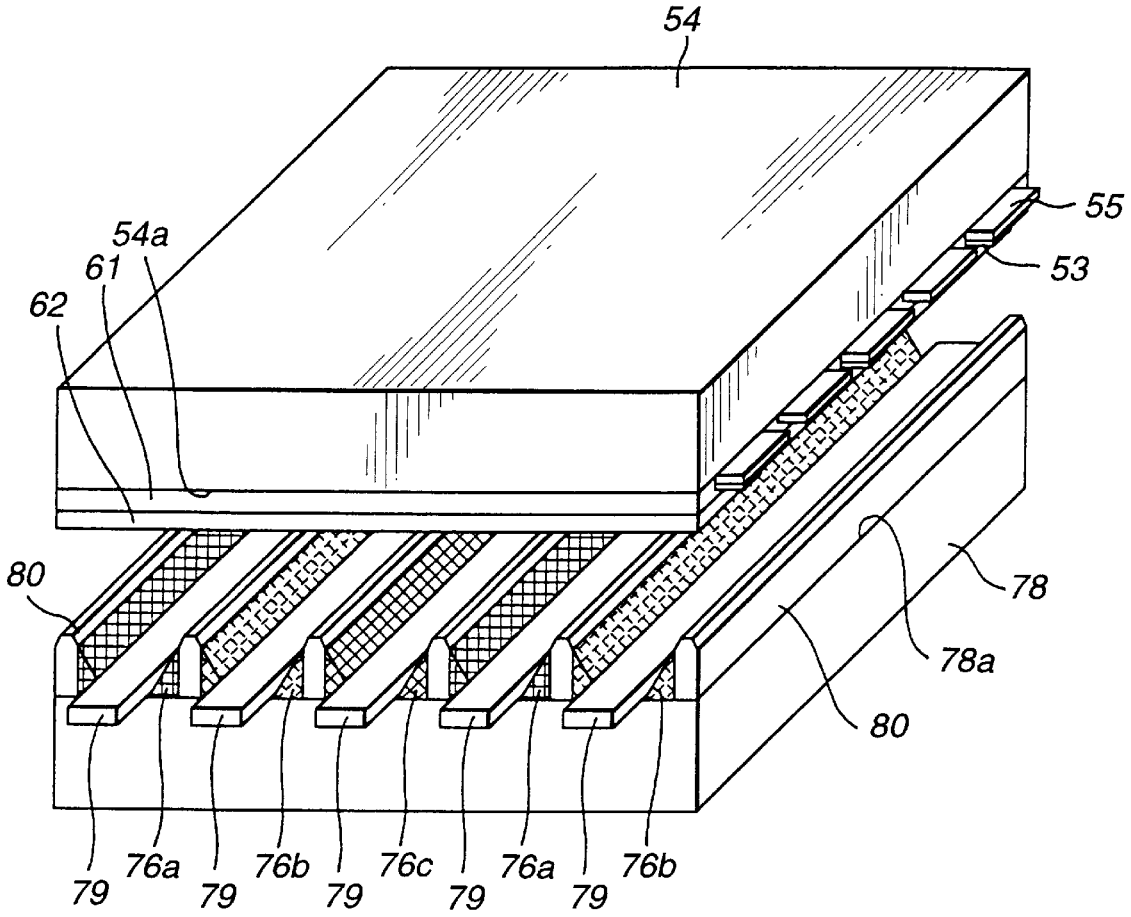
FIG. 21 is an enlarged schematic exploded perspective view showing a further example of a picture display device manufactured by the manufacturing method for the picture display device embodying the present invention.

That is, a first substrate 78 having parallel line-shaped partitioning wall sections 80 formed on its major surface 78*a* as the facing surface at a pre-set separation for extending in a pre-set direction and having phosphor elements 76*a,* 76*b* and 76*c* repeatedly arrayed in the spacing delimited between the neighboring partitioning wall sections 80, as shown in FIGS. 20 and 21. As these phosphor elements 76*a,* 76*b* and 76*c,* red, green and blue phosphors, for example, are used. In the spacing delimited between the neighboring partitioning wall sections 80, there are formed plural parallel line-shaped address electrodes 79 which herein are layered on the phosphor elements 76*a,* 76*b* and 76*c*. That is, these address electrodes 79 also are arrayed side-by-side at a pre-set separation in a pre-set direction. A through-hole 74 is formed so as to clear the address electrodes 79 and the partitioning wall sections 80.

As the plate member, the second substrate 54, used in the manufacture of the above-described AC type PDP, is used. Thus, the same numerals are used to depict the same components and the corresponding description is omitted for clarity.

The first substrate 78 and the second substrate 54 are placed so that the major surfaces 78*a,* 54*a* thereof face each other and so that the distal ends of the partitioning wall sections 80 compress against the surface of the protective film 62. The perimetral portions of the two components are sealed by a frit sealant 81 in order to complete a hermetically sealed assembly 91. In this hermetically sealed assembly 91, spacing sections 82 surrounded by the partitioning wall sections 80 and the protective layer 62 of the second substrate 54 are defined in register with the address electrodes 79 of the first substrate 78. The address electrodes 79 are formed between the first substrate 78 and the second substrate 54.

As in the above-described manufacturing method, the glass tube 65 is connected by the bond 72 of the frit material in the opening of the major surface 78*b* in the first substrate 78 opposite to the major surface 78*a* operating as its facing surface.

As in the above-described manufacturing method, the calcined solid frit is placed in the glass tube 65. The calcined solid frit described previously is used.

Also, as in the above-described manufacturing method, the calcined solid frit is melted and solidified to seal the glass tube 65, while an unneeded portion of the glass tube 65 is cut off to complete the AC type PDP shown in FIG. 20.

The display electrodes 5 and the address electrodes 59 operate as the column driving units and as the row driving units, respectively. The intersecting points of these two driving units correspond to pixels. A picture is formed by excitation of the phosphor elements 76*a,* 76*b* and 76*c* arrayed in the spacing sections 82 corresponding to these pixels.

Figure 22:
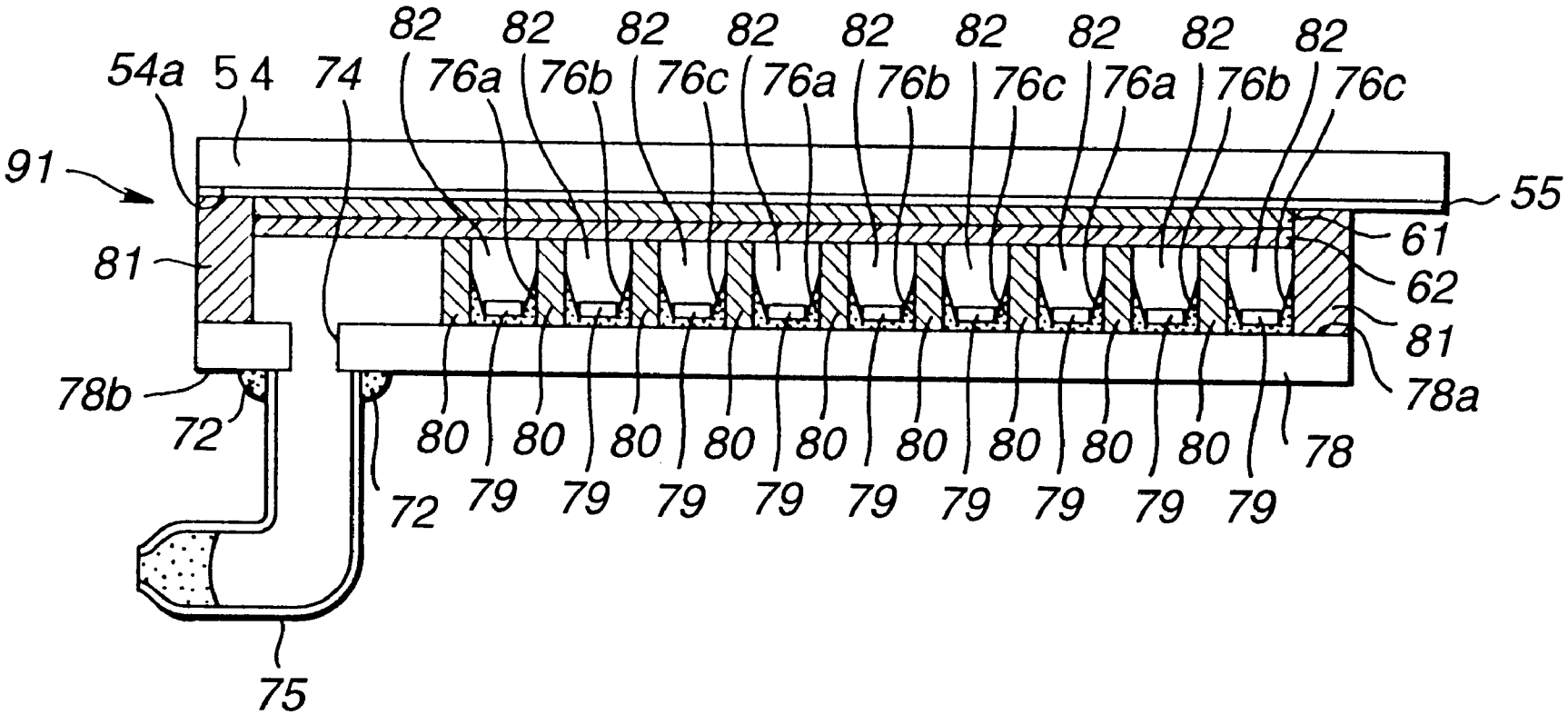
FIG. 22 is an enlarged schematic cross-sectional view showing a further example of a picture display device manufactured by the manufacturing method for the picture display device embodying the present invention.

Although the glass tube 65 used is of a linear shape, an L-shaped glass tube 75 as shown in FIG. 22 may also be used. Since the AC type PDP shown in FIG. 22 is configured similarly to the AC type PDP shown in FIG. 16, the same components are depicted by the same reference numerals and the corresponding description is omitted for clarity. If the glass tube 75 is L-shaped, the glass tube 75 takes up less space to render it possible to reduce the thickness of the PDP in its entirety.

For mass-producing the picture display devices of the present invention, several to tens of glass tubes are arrayed and interconnected side-by-side and the evacuation step and the gas introducing step are executed simultaneously for possibly improving the production efficiency. However, if the glass tubes are protruded perpendicularly from the display device, the spacing between the glass tubes arrayed side-by-side is increased to render the production device bulky in size because the size of the main body portions of the display device (substrates) act as a hindrance in interconnecting the glass tubes side-by-side. If the glass tubes 75 are arrayed in the L-shape, the display device in its entirety (substrates) is reduced in thickness, so that, if the glass tubes are arrayed and interconnected side-by-side, the spacing between the main body portions of the display device can be straightened to reduce the size of the production device to improve the production efficiency.

By forming the glass tube 75 in the L-shape, not only can the completed display device be reduced in thickness but also efficient production and cost reduction may be achieved. Of course, the bending angle of the glass tube is not limited to 90° and may be larger or smaller than 90° or plural bends may be provided in the tube if the structure is such as to permit application of the present invention.

An embodiment of the present invention in which the invention is applied to the manufacture of DC type PDP is explained. The manufacturing method for the DC type PDP is similar to the previously explained manufacturing method for the AC type PDP, with the point of significant difference being that different first substrate and the plate member are used.

Figure 23:
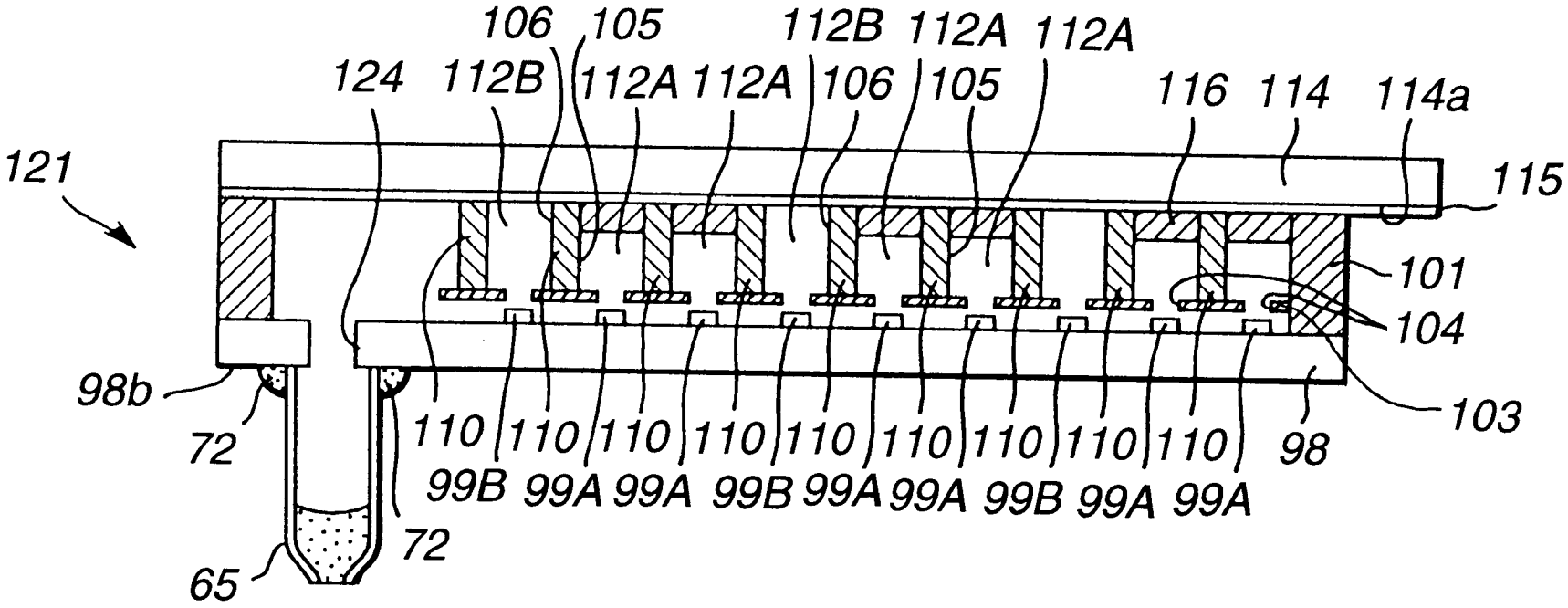
FIG. 23 is an enlarged schematic cross-sectional view showing a further example of a picture display device manufactured by the manufacturing method for the picture display device embodying the present invention.
Figure 24:
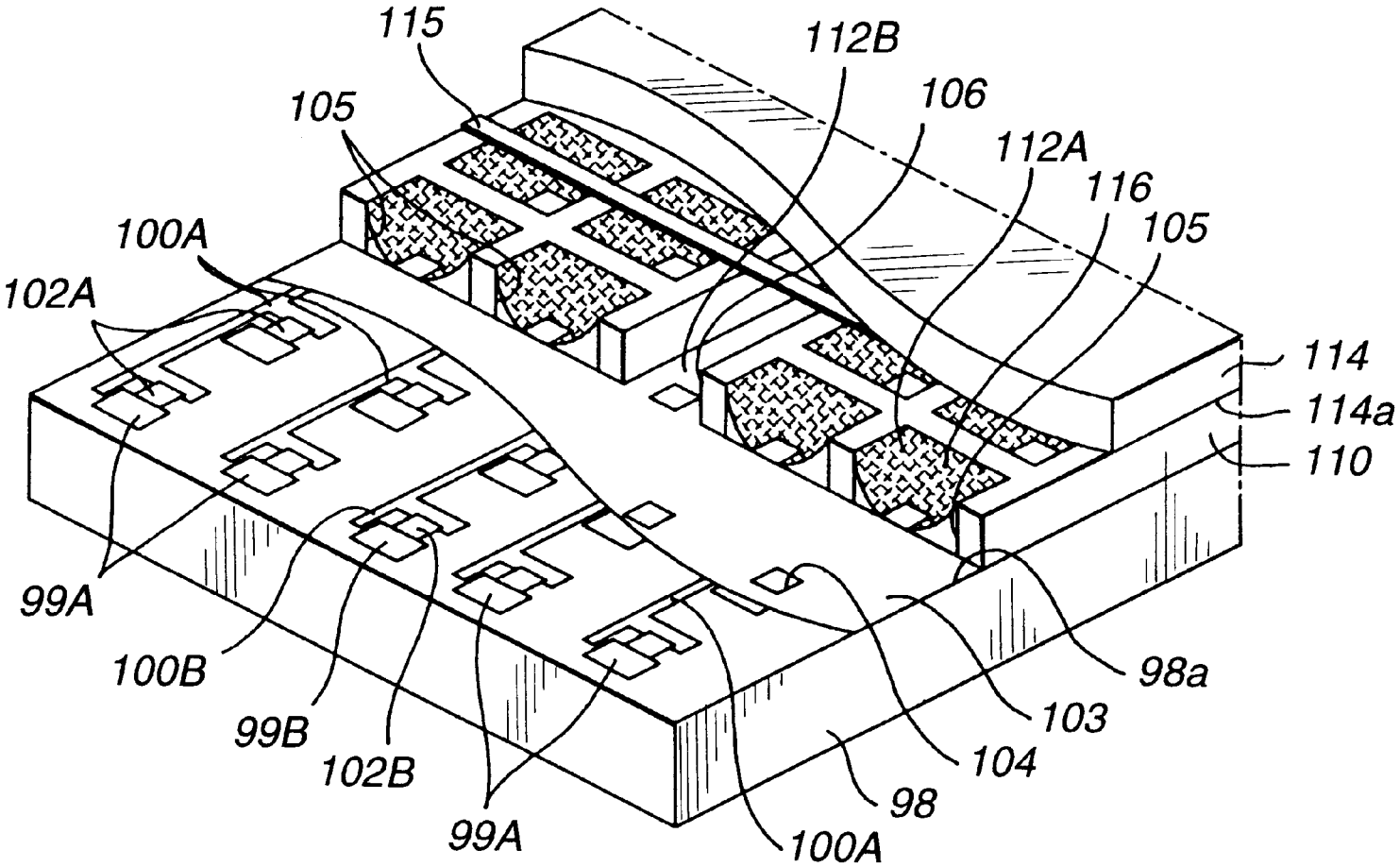
FIG. 24 is an enlarged schematic exploded perspective view showing yet another example of a picture display device manufactured by the manufacturing method for the picture display device embodying the present invention.

Referring to FIGS. 23 and 24, showing a DC type PDP, a first substrate 98, having on its major surface 98*a* as a facing surface plural display positive electrodes 99A of a planar square shape for operating as electrodes. Specifically, a number of the auxiliary display positive electrodes 99B are arrayed side-by-side at a pre-set separation in a pre-set direction and are interconnected by display positive electrode leads 100A, not shown in FIG. 23, for forming a set of parallel line-shaped display positive electrodes extending substantially in the pre-set direction. The display positive electrodes 99A and the display positive electrode leads 100A are interconnected by resistors 102A in order to suppress the discharge current value to a smaller value to improve the product service life.

On the major surface 98*a* of the first substrate 98 are also formed plural auxiliary positive electrodes 99B of a plan-parallel configuration. Specifically, a number of the auxiliary display positive electrodes 99B are arrayed side-by-side at a pre-set separation in a pre-set direction and are interconnected by auxiliary display positive electrode leads 100B for forming a set of parallel line-shaped auxiliary positive electrodes extending substantially in the pre-set direction. The auxiliary positive electrodes 99A and the auxiliary positive electrode leads 100B are interconnected by resistors 102B in order to suppress the discharge current value to a smaller value to improve the product service life.

A column of auxiliary positive electrodes is arrayed adjacent to two columns of the display positive electrodes adjacent to which further two columns of the display positive electrodes are arrayed.

On the first substrate 98 is placed a dielectric film 103 for overlying the major surface 98*a* of the first substrate 98 carrying the display positive electrodes 99A and the auxiliary display positive electrodes 99B. The portions of the dielectric film 103 in register with the display positive electrodes 99A and the auxiliary display positive electrodes 99B are formed with openings 104, with the dielectric film 103 being insulated in its remaining portions. The dielectric film 103 used is of white color in order to reflect the light emitted byte phosphor. A through-hole 124 is formed in the first substrate 98 so as to clear the set of the display positive electrodes and the set of the auxiliary positive electrodes.

The plate member is a second substrate 114 on the facing major surface 114*a* of which plural parallel line-shaped negative electrodes 115 are formed for extending side-by-side substantially at right angles to the arraying direction of the set of the display electrodes, as shown in FIGS. 23 and 24. It is noted that, in these figures, only one of the negative electrodes are shown.

In the second substrate 114, a plurality of frame-shaped partitioning wall sections 110, each having plural windows of planar square shape, are formed for overlying the negative electrodes 115. These windows 105 are formed in the partitioning wall sections 110 in register with the display positive electrodes 99A of the set of the display positive electrodes, such that the windows 105 are formed in register with the display positive electrodes 99A of the set of the display positive electrodes. Also, in register with the auxiliary display positive electrodes 99B are formed grooves 106 in register with the set of the auxiliary display positive electrodes. The negative electrodes 115 are arrayed so as to be partially exposed at the windows 105.

That is, if the first substrate 98 and the second substrate 114 are placed facing each other, the negative electrodes and the display positive electrodes 99A face each other only at the portions in register with the windows 105, so that these portions operate as the display cells 112A. It is noted that the four display cells 112A neighboring to one another in the fore-and-aft direction and in the left-and-right direction form a sole pixel and a phosphor element 116 is placed within the display cells 112A towards the first substrate 98 except the lateral side of the partitioning wall section 115 and the display positive electrodes 99A. Of these phosphor elements, those associated with two display cells 112A may be of the green color, while those associated with the remaining display cells 112A may be separately of the blue and the red color.

In the grooves 106, the negative electrodes 115 and the auxiliary display positive electrodes 99B face each other, these facing portions operating as the auxiliary cells 112B. That is, there is one auxiliary cell 112B for two display cells 112A. The purpose of this auxiliary cell 112B is to allow charged particles or quasi-stable particles generated on electrical discharge in the auxiliary cell 112B to be intruded into left and right side display cells 112A to lower the discharge starting voltage.

For manufacturing the DC type PP, the first substrate 98 and the second substrate 114 are placed so that the major surfaces 98*a*, 114*a* thereof face each other. The first substrate 98 and the second substrate 114 are layered so that the distal ends of the partitioning wall sections 110 compress against the surface of the dielectric film 103. The perimetral portions of the resulting assembly are then sealed with a frit sealant 101 to complete the hermetically sealed assembly 121, as shown in FIG. 23.

Then, as in the above-described manufacturing method, a bond 72 of a frit material is used to connect the glass tube 65 to an opening portion of a through-hole 124 in the major surface 98*b* of the first substrate 98 opposite to its facing major surface 98*a*.

Then, as in the above-described manufacturing method, a calcined solid frit is placed in the inside of the glass tube 65. The calcined solid frit explained previously may be used.

Then, as in the above-described manufacturing method, the inside of the hermetically sealed assembly 121 is evacuated via glass tube 65 and the pre-set portion of the glass tube 65 is constricted. The calcined solid frit is then moved to a pre-set position and the gas is charged into the inside of the hermetically sealed assembly 121.

Finally, as in the above-described manufacturing method, the calcined solid frit is melted and solidified to seal the glass tube 65 and an unneeded portion of the glass tube 65 is cut off to complete the DC type PDP as shown in FIG. 23.

In the present DC type PDP, the phosphor elements 116 are energized in the display cells 112A to form a picture.

In the above embodiment, a linear glass tube is used as the glass tube 65. However, an L-shaped glass tube such as one shown above may be used, in which case the glass tube portion may be reduced to reduce the size of the PDP in its entirety.

For mass-producing the picture display devices of the present invention, several to tens of glass tubes are arrayed and interconnected side-by-side and the evacuation step and the gas introducing step are executed simultaneously for possibly improving the production efficiency. However, if the glass tubes are protruded perpendicularly from the display device, the spacing between the glass tubes arrayed side-by-side is increased to render the production device bulky in size because the size of the main body portions of the display device (substrates) act as a hindrance in interconnecting the glass tubes side-by-side. If the glass tubes 75 are arrayed in the L-shape, the display device in its entirety (substrates) is reduced in thickness, so that, if the glass tubes are arrayed and interconnected side-by-side, the spacing between the main body portions of the display device can be straightened to reduce the size of the production device to improve the production efficiency.

By forming the glass tube 75 in the L-shape, not only can the completed display device be reduced in thickness but also efficient production and cost reduction may be achieved. Of course, the bending angle of the glass tube is not limited to 90° and may be larger or smaller than 90° or plural bends may be provided in the tube if the structure is such as to permit application of the present invention.

In the above embodiment, the first substrate used is such a substrate on the facing surface of which plural electrodes acting as positive electrodes are arrayed substantially parallel to one another, while the second substrate is such a substrate on the facing surface of which electrodes as negative electrodes are arrayed for extending substantially at right angle to the anode electrodes and phosphor elements are also arrayed. Alternatively, the first and second substrates used may be such a substrate on the facing surface of which electrodes operating as negative electrodes are formed for extending substantially at right angles to the anode electrodes and phosphor elements are also deposited and such a substrate on the facing surface of which plural electrodes operating as positive electrodes are formed for extending substantially parallel to one another, respectively.

For confirming the effects of the present invention, the following experiments were conducted. That is, a pair of fluted glass plates were arrayed at a pre-set distance from each other and the perimetral portion of the resulting assembly are sealed with a frit material to provide a hermetically sealed assembly. In one of the glass plates of the hermetically sealed assembly is bored a through-hole in which is connected a glass tube. A calcined solid frit is placed in the glass tube via which the inside of the hermetically sealed assembly is evacuated and the glass tube is radially constricted at such a position as to allow the calcined solid frit is placed between it and the through-hole to form a constructed portion. The calcined solid frit is then moved to the constricted portion and melted and solidified, after which it was checked as to the possible destruction of the hermetically sealed assembly or the glass tube and as to the hermetically sealed state.

Figure 25:
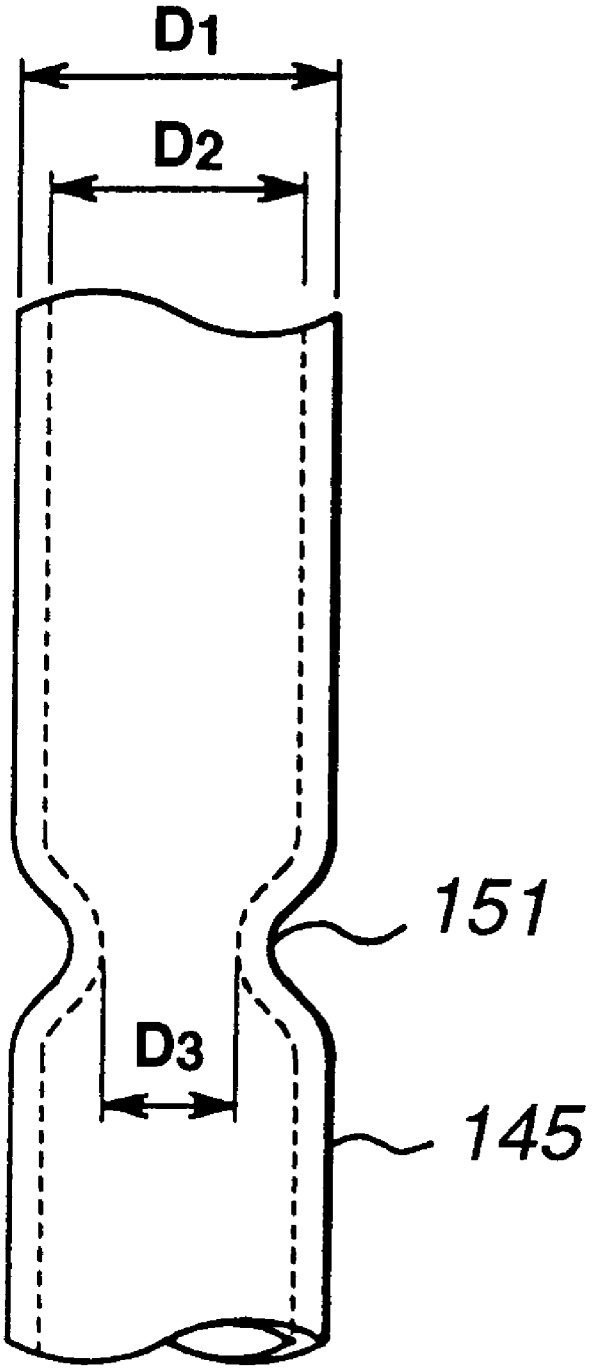
FIG. 25 is a side view for illustrating the relation between inner and outer diameters and the constricted portion of the glass tube.

The gas pressure in the hermetically sealed assembly was set to 1 kgf/cm$^2$ to 1.2 kgf/cm$^2$. As the glass tube, such a glass tube 145 having the thermal expansion coefficient of 94 ×10−7 cm/cm/° C. and an outer diameter D1 and an inner diameter D2 shown in FIG. 25 of 9.2 mm and 5.5 mm, respectively, was used. The calcined solid frit was manufactured from LS-0206 (trade name) manufactured by NIPPON DENKI GLASS KK. Specifically, the calcined solid frit was molded at a pressure of 5 kg/cm$^2$ using a metal mold having an inner diameter of 5 mm, and was provisionally fired for ten minutes at 390° to 400° C. in order to produce a fired columnar product having a diameter of 5 mm and a height of 5 to 6 mm. The glass tube 145 was radially compressed at the above-mentioned pre-set position until the inner diameter shown at D3 in FIG. 25 was 3 mm in order to from a constricted portion 151. The calcined solid frit was melted at 430° to 450° C. for two minutes.

It was found that the hermetically sealed assembly was not destructed, while the glass tube was also not destructed, with the hermetically sealed state was also satisfactory. That is, if the picture display device is manufactured in accordance with the present invention, the picture display device can be manufactured with high reliability even if the gas pressure in the hermetically sealed assembly is of the order of one atmosphere.

Although other modifications and changes may be suggested by those skilled in the art, it is the intention of the inventors to embody within the patent warranted hereon all changes and modifications as reasonably and properly come within the scope of their contribution to the art.

What is claimed is:

1. A method for producing a picture display device, comprising:

connecting a glass tube in an opening area of a through-hole formed at a pre-set position of a major surface of a first substrate opposite to its other major surface facing a plate member placed at a pre-set separation from said first substrate, said first substrate and the plate member placed thereon constituting an assembly the peripheral portions of which are hermetically sealed to form a hermetically sealed assembly;

applying a calcined solid frit body held by a holding member in a vicinity of a bond of the glass tube to the through-hole in the glass tube;

evacuating the space between the first substrate and the plate member via said glass tube;

radially compressing a pre-set portion of the glass tube to form a constricted portion, with the calcined solid frit body being left between the constricted portion and the opening area of said through-hole;

moving the calcined solid frit body to the constricted portion of the glass tube;

charging the gas into the space between the first substrate and the plate member via said glass tube; and melting and solidifying the calcined solid frit in the constricted portion in the glass tube for hermetically sealing the constricted portion;

wherein the holding member for the calcined solid frit body is made up of a metal plate inserted into the calcined solid frit body and a spring member for holding the metal plate in the glass tube;

said metal plate being heated by high frequency heating for dismounting the calcined solid frit body from the holding member for moving the calcined solid frit body to the constricted portion.

2. The method as claimed in claim 1 wherein a plurality of discharge electrodes are formed substantially parallel to one another while a thin dielectric sheet is arranged as the plate member and a plasma cell is formed as the hermetically sealed assembly; said method further comprising:

a step performed subsequently to said melting step, said step being a step of layering a second substrate on the thin dielectric sheet of the plasma cell via an electro-optical layer, said second substrate having electrodes formed thereon on its facing surface for extending substantially at right angles to the discharge electrodes on the first substrate of the plasma cell.

3. The method as claimed in claim 1 wherein the first substrate or the plate member has on its facing surface a plurality of discharge electrodes formed for extending substantially parallel to one another;

the plate member or the first substrate having on its facing surface a plurality of address electrodes formed for extending substantially at right angle with the discharge electrodes, said plate member or the first substrate having on its facing surface a plurality of phosphor elements deposited thereon.

4. The method as claimed in claim 1 wherein the first substrate or the plate member has on its facing surface a plurality of discharge electrodes for extending substantially parallel to one another;

the plate member of the first substrate having phosphor elements deposited on its facing surface;

the hermetically sealed assembly having a plurality of address electrodes formed between the first substrate and the plate member for extending substantially at right angles to the discharge electrodes.

5. The method as claimed in claim 1 wherein the first substrate or the plate member has on its facing surface a plurality of first electrodes formed for extending substantially parallel to one another;

the plate member or the first substrate having on its facing surface a plurality of second electrodes formed for extending substantially at right angle with the first electrodes; said plate member or the first substrate having on its facing surface a plurality of phosphor elements deposited on its major surface.

6. A method for producing a picture display device, comprising:

connecting a glass tube in an opening area of a through-hole formed at a pre-set position of a major surface of a first substrate opposite to its other major surface facing a plate member placed at a pre-set separation from said first substrate, said first substrate and the plate member placed thereon constituting an assembly the peripheral portions of which are hermetically sealed to form a hermetically sealed assembly;

applying a calcined solid frit body held by a holding member in a vicinity of a bond of the glass tube to the through-hole in the glass tube;

evacuating the space between the first substrate and the plate member via said glass tube;

radially compressing a pre-set portion of the glass tube to form a constricted portion, with the calcined solid frit body being left between the constricted portion and the opening area of said through-hole;

moving the calcined solid frit body to the constricted portion of the glass tube;

charging the gas into the space between the first substrate and the plate member via said glass tube; and melting and solidifying the calcined solid frit in the constricted portion in the glass tube for hermetically sealing the constricted portion;

wherein the holding member for the calcined solid frit body is made up of a ferromagnetic plate inserted into the calcined solid frit body and a spring member for holding the metal plate in the glass tube;

said ferromagnetic plate being excited into vibrations by an electro-magnet for moving the calcined solid frit body along with the holding member to the constricted portion.

7. The method as claimed in claim 6 wherein a plurality of discharge electrodes are formed substantially parallel to one another while a thin dielectric sheet is arranged as the plate member and a plasma cell is formed as the hermetically sealed assembly; said method further comprising:

a step performed subsequently to said melting step, said step being a step of layering a second substrate on the thin dielectric sheet of the plasma cell via an electro-optical layer, said second substrate having electrodes formed thereon on its facing surface for extending substantially at right angles to the discharge electrodes on the first substrate of the plasma cell.

8. The method as claimed in claim 6, wherein the first substrate or the plate member has on its facing surface a plurality of discharge electrodes formed for extending substantially parallel to one another;

the plate member or the first substrate having on its facing surface a plurality of address electrodes formed for extending substantially at right angles with the discharge electrodes, said plate member or the first substrate having on its facing surface a plurality of phosphor elements deposited thereon.

9. The method as claimed in claim 6, wherein the first substrate or the plate member has on its facing surface a plurality of discharge electrodes for extending substantially parallel to one another;

the plate member of the first substrate having phosphor elements deposited on its facing surface;

the hermetically sealed assembly having a plurality of address electrodes formed between the first substrate and the plate member for extending substantially at right angles to the discharge electrodes.

10. The method as claimed in claim 6, wherein the first substrate or the plate member has on its facing surface a plurality of first electrodes formed for extending substantially parallel to one another;

the plate member or the first substrate having on its facing surface a plurality of second electrodes formed for extending substantially at right angles with the first electrodes; said plate member or the first substrate having on its facing surface a plurality of phosphor elements deposited on its major surface.

* * * * *